US006801178B2

(12) United States Patent
Nitta et al.

(10) Patent No.: US 6,801,178 B2
(45) Date of Patent: Oct. 5, 2004

(54) LIQUID CRYSTAL DRIVING DEVICE FOR CONTROLLING A LIQUID CRYSTAL PANEL AND LIQUID CRYSTAL DISPLAY APPARATUS

(75) Inventors: Hiroyuki Nitta, Fujisawa (JP); Tsutomu Furuhashi, Yokohama (JP); Makoto Kimura, Higashimurayama (JP); Hirobumi Koshi, Chosei (JP); Takeshi Maeda, Yokosuka (JP)

(73) Assignee: Hitachi, Ltd., Tokyo (JP)

( * ) Notice: Subject to any disclaimer, the term of this patent is extended or adjusted under 35 U.S.C. 154(b) by 303 days.

(21) Appl. No.: 09/911,716

(22) Filed: Jul. 25, 2001

(65) Prior Publication Data

US 2002/0011979 A1 Jan. 31, 2002

(30) Foreign Application Priority Data

Jul. 27, 2000 (JP) ..... 2000-231392

(51) Int. Cl.[7] ..... G09G 3/36
(52) U.S. Cl. ..... 345/89
(58) Field of Search ..... 345/89, 690, 210, 345/211

(56) References Cited

U.S. PATENT DOCUMENTS 5,489,918 A * 2/1996 Mosier ..... 345/89
5,534,883 A * 7/1996 Koh ..... 345/3.2
5,784,041 A * 7/1998 Okada et al. ..... 345/89
5,796,379 A * 8/1998 Enomoto et al. ..... 345/89
5,956,007 A * 9/1999 Ito et al. ..... 345/89
6,396,465 B1 * 5/2002 Nakagiri ..... 345/69
6,535,224 B2 * 3/2003 Kuriyama et al. ..... 345/690

* cited by examiner

*Primary Examiner*—Xiao Wu
*Assistant Examiner*—Kevin M. Nguyen
(74) *Attorney, Agent, or Firm*—Antonelli, Terry, Stout & Kraus, LLP

(57) ABSTRACT

A liquid crystal driving device for controlling a liquid crystal panel and a liquid crystal display apparatus. Reference voltages are generated in a data driver from input reference voltages, and reference voltages are selected in accordance with the settings of gray scale control registers thereby to control the gray scale voltages. The gray scale control registers can be set using a data bus for transferring the display data from a liquid crystal controller, and the gray scale control operation is performed by the liquid crystal controller in accordance with the image data

28 Claims, 33 Drawing Sheets

FIG. 9

| NO | PORT | RS | P4~0 | DATA BITS | | | | | | CONTENTS |
|---|---|---|---|---|---|---|---|---|---|---|
| 1 | 0 | 0 | P0 | B6 | B5 | B4 | B3 | B2 | B1 | SET TO B1 TO B6 |
| 2 | 1 | 0 | P1 | W6 | W5 | W4 | W3 | W2 | W1 | SET TO W1 TO W6 |
| 3 | 2 | 0 | P2 | D5 | D4 | D3 | D2 | D1 | D0 | SET TO V1B |
| 4 | 3 | 0 | P3 | D5 | D4 | D3 | D2 | D1 | D0 | SET TO V2B |
| 5 | 4 | 0 | P4 | D5 | D4 | D3 | D2 | D1 | D0 | SET TO V3B |
| 6 | 0 | 1 | P0 | D5 | D4 | D3 | D2 | D1 | D0 | SET TO V4B |
| 7 | 1 | 1 | P1 | D5 | D4 | D3 | D2 | D1 | D0 | SET TO V5B |
| 8 | 2 | 1 | P2 | D5 | D4 | D3 | D2 | D1 | D0 | SET TO V6B |
| 9 | 3 | 1 | P3 | D5 | D4 | D3 | D2 | D1 | D0 | SET TO V7B |
| 10 | 5 | — | — | RS | P4 | P3 | P2 | P1 | P0 | CONTROL REGISTER |

P4~P0='1': WRITE IN CORRESPONDING GRAY SCALE CONTROL REGISTER

P4~P0='0': DON'T WRITE IN CORRESPONDING GRAY SCALE CONTROL REGISTER

RS='0': SELECT GRAY SCALE CONTROL REGISTERS OF B1 TO B6, W1 TO W6, V1B TO V3B

RS='1': SELECT GRAY SCALE CONTROL REGISTERS OF V4B TO V7B

FIG. 36

| NO. | ADDRESS | CONTENTS | | | | | | CONTENTS |
|---|---|---|---|---|---|---|---|---|
| 1 | 0 | B6 | B5 | B4 | B3 | B2 | B1 | SET TO B1 TO B6 |
| 2 | 1 | W6 | W5 | W4 | W3 | W2 | W1 | SET TO W1 TO W6 |
| 3 | 2 | — | S4 | S3 | S2 | S1 | S0 | SET TO V1B |
| 4 | 3 | — | S4 | S3 | S2 | S1 | S0 | SET TO V2B |
| 5 | 4 | — | S4 | S3 | S2 | S1 | S0 | SET TO V3B |
| 6 | 5 | — | S4 | S3 | S2 | S1 | S0 | SET TO V4B |
| 7 | 6 | — | S4 | S3 | S2 | S1 | S0 | SET TO V5B |
| 8 | 7 | — | S4 | S3 | S2 | S1 | S0 | SET TO V6B |
| 9 | 8 | — | S4 | S3 | S2 | S1 | S0 | SET TO V7B |

LIQUID CRYSTAL DRIVING DEVICE FOR CONTROLLING A LIQUID CRYSTAL PANEL AND LIQUID CRYSTAL DISPLAY APPARATUS

BACKGROUND OF THE INVENTION

The present invention relates to a liquid crystal driving device for controlling a liquid crystal panel and a liquid crystal display apparatus for displaying display data.

In the conventional liquid crystal display device described in JP-A-11-337909, a plurality of gray scale characteristics are preset in a gray scale voltage generating circuit, and the gray scale characteristic to be used is selected in accordance with a switch operable by the user or a select signal from a computer using the liquid crystal display device as a display monitor. Especially, the gray scale characteristic is automatically switched in operatively interlocked relation with the switching of the display mode of the computer.

Nevertheless, the liquid crystal display device disclosed in JP-A-11-337909 is not shown to have any function to control the gray scale characteristic for each frame or each image scene of an animation. Therefore, in the animation, for example, the gray scale characteristic is required to be set by the user for each frame or image scene, thereby posing an excessively heavy load on the user.

SUMMARY OF THE INVENTION

An object of the present invention is to provide a liquid crystal display apparatus for realizing a high image quality display by eliminating gray scale irregularities.

Another object of the invention is to provide a liquid crystal display apparatus for realizing a high image quality display in accordance with each frame or each image scene.

Still another object of the invention is to provide a liquid crystal display apparatus for realizing the gray scale characteristic of an input video signal corresponding to the animation display of the TV broadcast or DVD and the text display for OA applications.

Yet another object of the invention is to provide a liquid crystal display apparatus for setting the gray scale characteristic controlled for each frame or each image scene free of gray scale irregularities without increasing the number of terminals.

According to one aspect of the invention, there is provided a liquid crystal driving device comprising a gray scale voltage generating circuit for generating a plurality of levels of gray scale voltage from a plurality of levels of reference voltage generated by a power circuit in accordance with the brightness distribution of display data and a gray scale voltage select circuit for selecting a gray scale voltage to be output to the liquid crystal panel from a plurality of levels of the gray scale voltages in accordance with the display data.

According to another aspect of the invention, there is provided a liquid crystal driving device comprising a gray scale voltage generating circuit for generating a plurality of levels of gray scale voltage from a plurality of levels of reference voltage generated by a power circuit based on the correspondence relationships between preset display data and the gray scale voltage and a gray scale voltage select circuit for selecting a gray scale voltage to be output to the liquid crystal panel from a plurality of levels of the gray scale voltage.

According to still another aspect of the invention, there is provided a liquid crystal display apparatus comprising a liquid crystal panel, a data driver circuit for generating a gray scale voltage from a reference voltage generated by a power circuit in accordance with the brightness distribution of the display data and outputting the gray scale voltage to the liquid crystal panel, a scanning driver circuit for selecting a line to which the gray scale voltage is output, and a controller circuit for driving the data driver circuit and the scanning driver circuit based on a display control signal and the display data.

According to yet another aspect of the invention, there is provided a liquid crystal display apparatus comprising a liquid crystal panel, a register circuit for holding the correspondence relationships between the display data and the gray scale voltage, a data driver circuit for generating a gray scale voltage from a reference voltage generated by a power circuit based on the correspondence relationships between the display data and the gray scale voltage and outputting the gray scale voltage to the liquid crystal panel, a scanning driver circuit for selecting a line to which the gray scale voltage is output, and a controller circuit for driving the data driver circuit and the scanning driver circuit based on a display control signal and the display data.

BRIEF DESCRIPTION OF THE DRAWINGS

FIG. 9 is a diagram showing the specifications of a gray scale control register.

FIG. 36 is a diagram showing the specifications of a gray scale control register.

DESCRIPTION OF THE EMBODIMENTS

A liquid crystal display apparatus according to this invention comprises a liquid crystal panel having a plurality of pixels arranged in matrix, a data driver circuit for outputting a liquid crystal gray scale voltage to the liquid crystal panel, a liquid crystal control circuit for converting a display control signal supplied from a system unit and display data representing and $2^N$ (N: positive integer) gray scale levels into a liquid crystal control signal for driving the data driver circuit and the scanning driver circuit and liquid crystal display data, respectively, and a power circuit for supplying a plurality of levels of reference voltage to the data driver. The data driver circuit generates $2^N$ levels of voltage from a plurality of reference voltages supplied from a gray scale control register circuit for holding the correspondence relationships between the liquid crystal display data and the liquid crystal gray scale voltage and the power circuit, and selects a gray scale generating reference voltage from the particular $2^N$ levels of voltage based on the correspondence relationships between the liquid crystal display data and the liquid crystal gray scale voltage held in the gray scale control register circuit.

Specifically, based on the brightness distribution of the display data input from an external source as a correspondence relationships between the liquid crystal display data and the liquid crystal gray scale voltage, a gray scale generating reference voltage providing a reference for the data driver to generate the gray scale voltage is determined, and a gray scale voltage is generated based on the particular gray scale generating reference voltage.

Also, the correspondence relationships between the liquid crystal display data and the liquid crystal gray scale voltage providing the brightness distribution of the display data input from an external source varies from one frame to another. This correspondence, therefore, is updated for each frame, and the display data providing the base of the brightness distribution is converted into a gray scale voltage based on the gray scale generating reference voltage determined by the display data and the resulting gray scale voltage is applied to the liquid crystal panel.

Further, the gray scale control register can be set using the data bus for transferring the display data from the liquid crystal controller, which controls the gray scale in accordance with the image data.

A first embodiment of the invention will be explained with reference to FIGS. 1 to 20.

Figure 1:
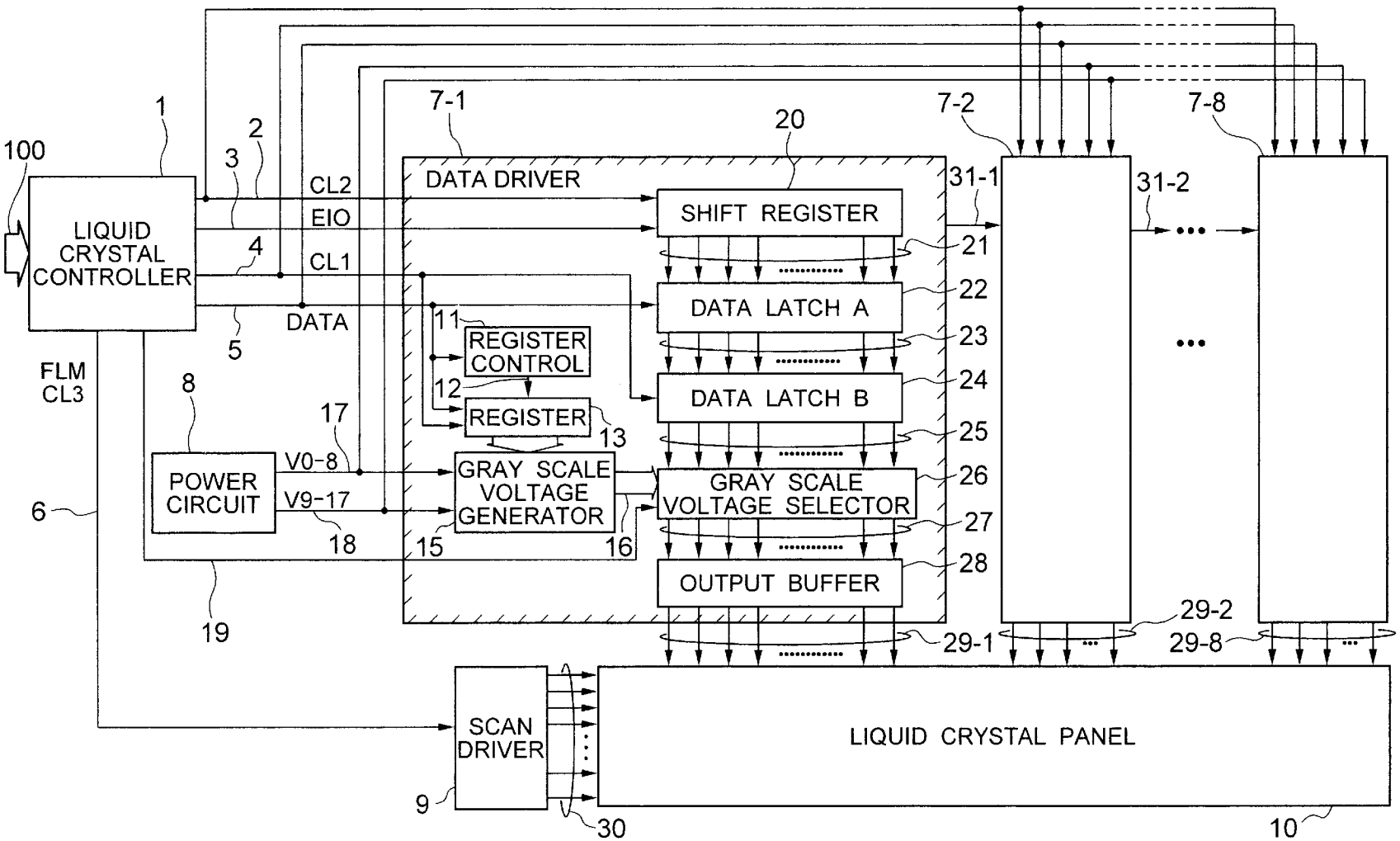
FIG. 1 is a block diagram showing a liquid crystal display apparatus according to an embodiment of the invention.

FIG. 1 is a diagram showing a configuration of a liquid crystal panel drive circuit according to the invention. This diagram shows a configuration of a liquid crystal display on a liquid crystal panel of 1280×RGB×1024 for displaying 256 gray scale levels for each of RGB and 1638400 colors. Reference numeral 100 designates a display signal group transferred from the system unit, numeral 1 a liquid crystal controller for converting the display signal group 100 into a sync signal for the liquid crystal driver and display data, numeral 2 a data sync clock, numeral 3 a valid data start signal, numeral 4 a data horizontal sync signal, numeral 5 display data, numeral 6 a scanning driver control signal group, and numerals 7-1 to 7-8 data drivers for 256 gray scale levels and 480 outputs. The eight data drives 7-1 to 7-8 drive the liquid crystal panel. Numeral 8 designates a power circuit for generating a positive reference voltage 17 and a negative reference voltage 18 of the gray scale voltage for driving the liquid crystal, numeral 9 a scanning driver for scanning the liquid crystal, and numeral 10 a liquid crystal panel having a resolution of 1280×RGB×1024.

Numeral 11 designates a register control circuit, numeral 12 a register control signal group for controlling the register 13, and numeral 14 a register output signal for controlling the gray scale voltage generating circuit 15. The register 13 holds the correspondence relationships between the liquid crystal display data and the liquid crystal gray scale voltage. This correspondence will be explained later with reference to FIG. 13 and other figures. Numeral 16 designates a gray scale voltage signal group of 256 gray scale levels including positive and negative signals generated in the gray scale voltage generating circuit 15, and numeral 19 designates an AC signal for controlling the polarity of the alternating current. Numeral 20 designates a shift register, numeral 22 a data latch circuit for sequentially latching the display data 5 by the shift clock 21 generated in the shift register 20, numeral 24 a data latch circuit for simultaneously latching all the outputs including the output data 23 of the data latch circuit 22 by the data horizontal sync signal 4, numeral 26 a gray scale voltage select circuit for selecting the gray scale voltage from the gray scale voltage signal group 16 based on the output data 25 of the data latch circuit 24 and the AC signal 19, numeral 28 an output buffer circuit for outputting by buffering in a buffer circuit the gray scale voltage 27 selected by the gray scale voltage select circuit 26, numerals 29-1 to 29-8 gray scale drive voltages for driving the liquid crystal panel 10 of 1280×RGB×1024, and numeral 30 a scanning voltage.

Figure 2:
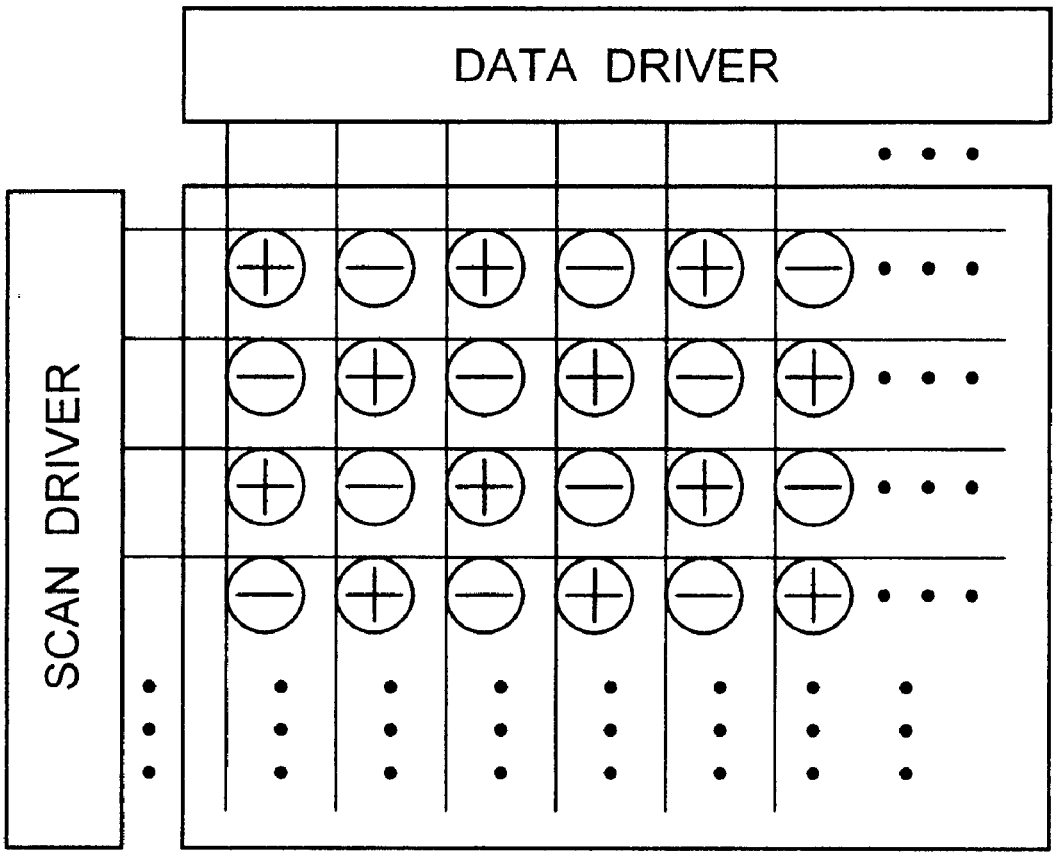
FIG. 2 is a diagram showing the dot inversion drive.
Figure 3:
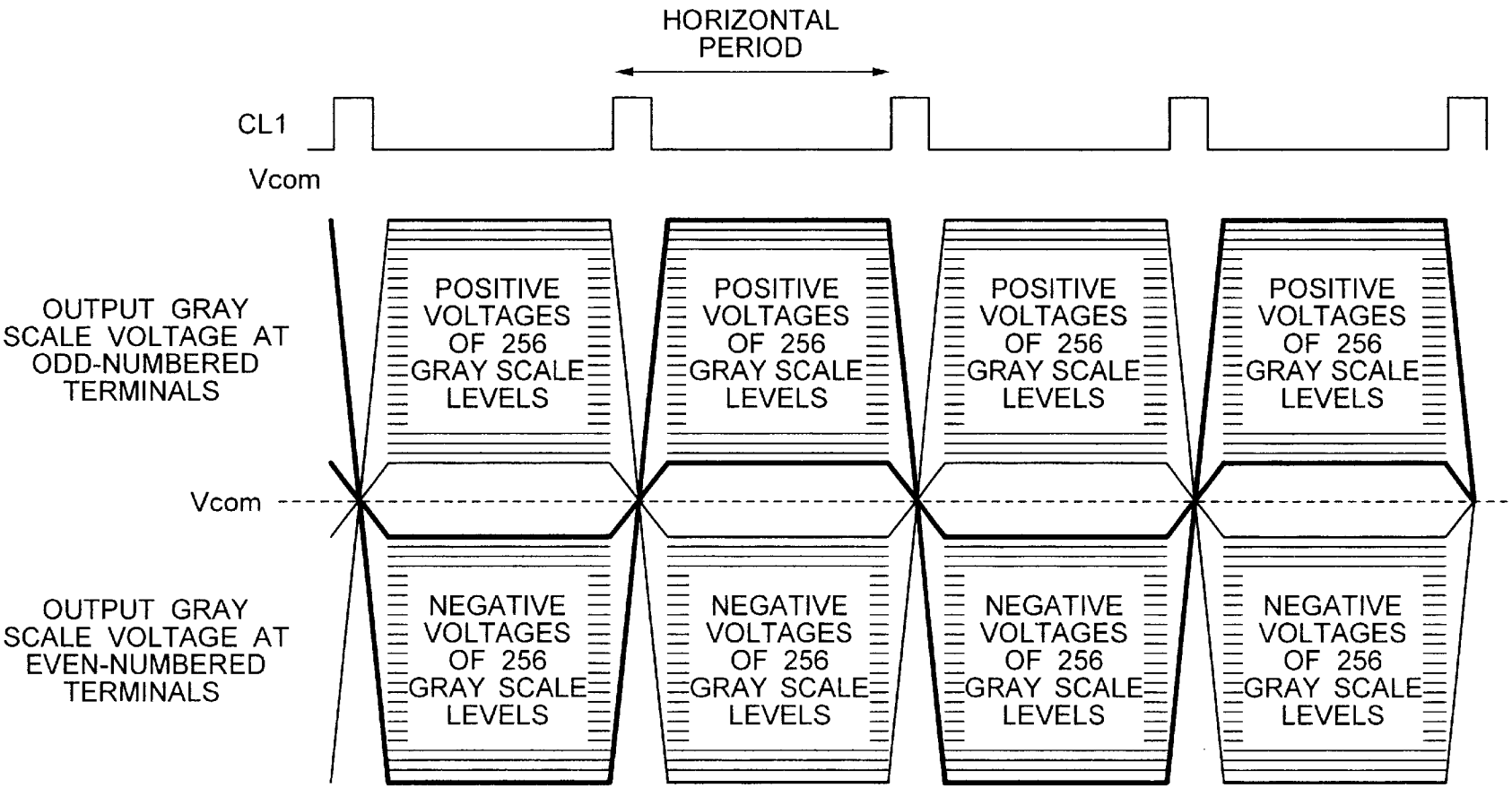
FIG. 3 is a timing chart of the dot inversion drive.
Figure 4:
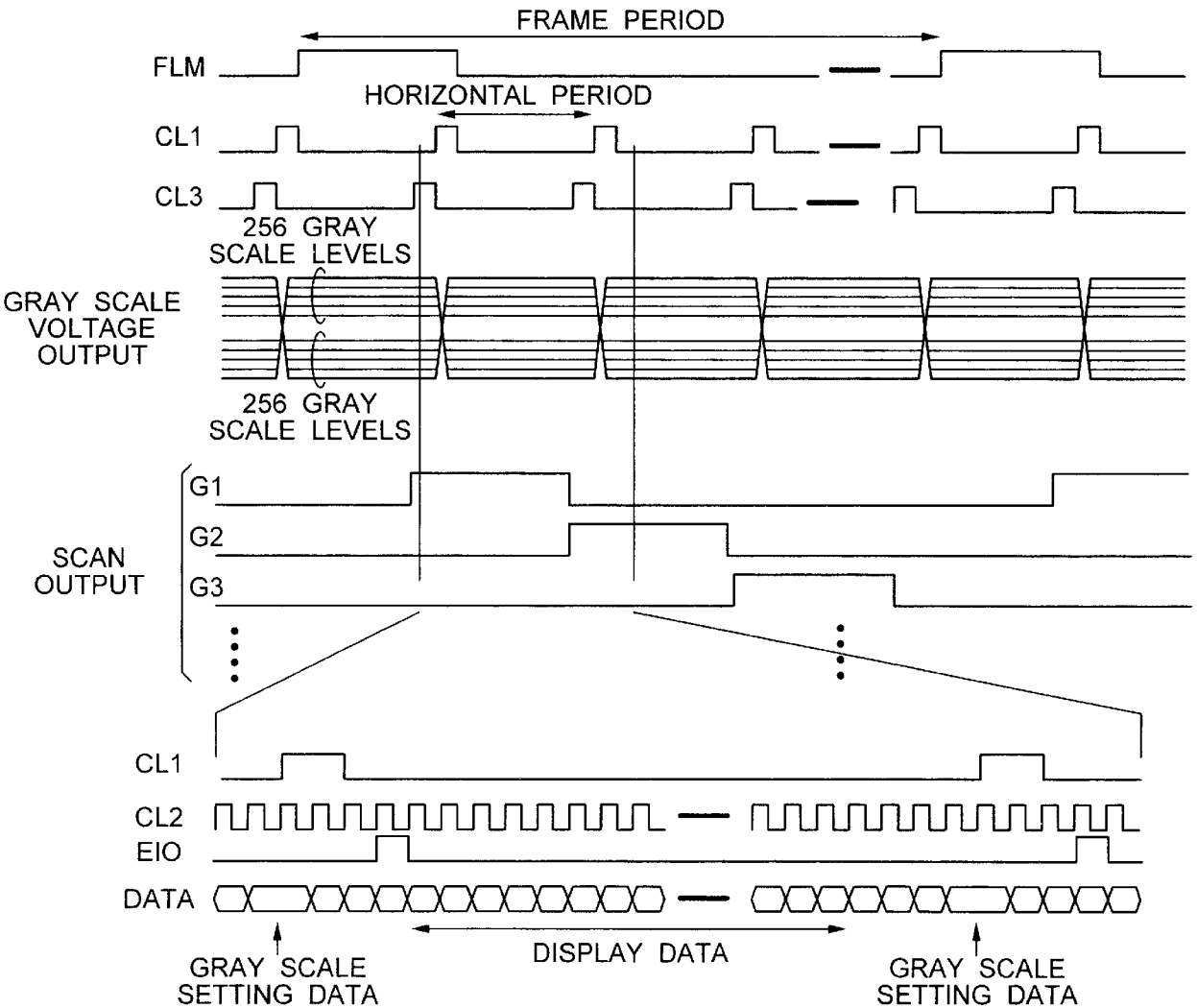
FIG. 4 is a diagram showing the drive timing of a liquid crystal display.
Figure 5:
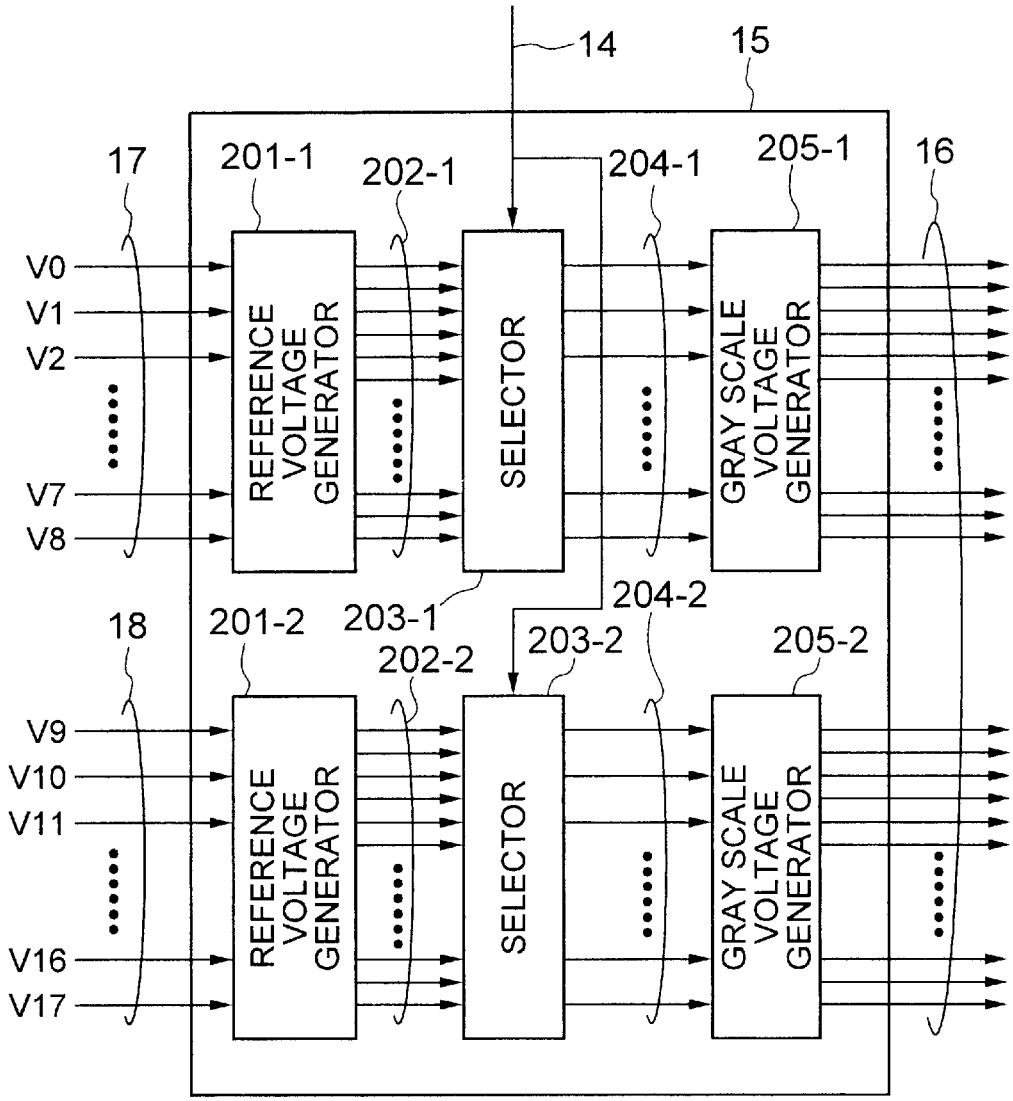
FIG. 5 is a diagram showing a configuration of a gray scale voltage generating circuit.
Figure 6:
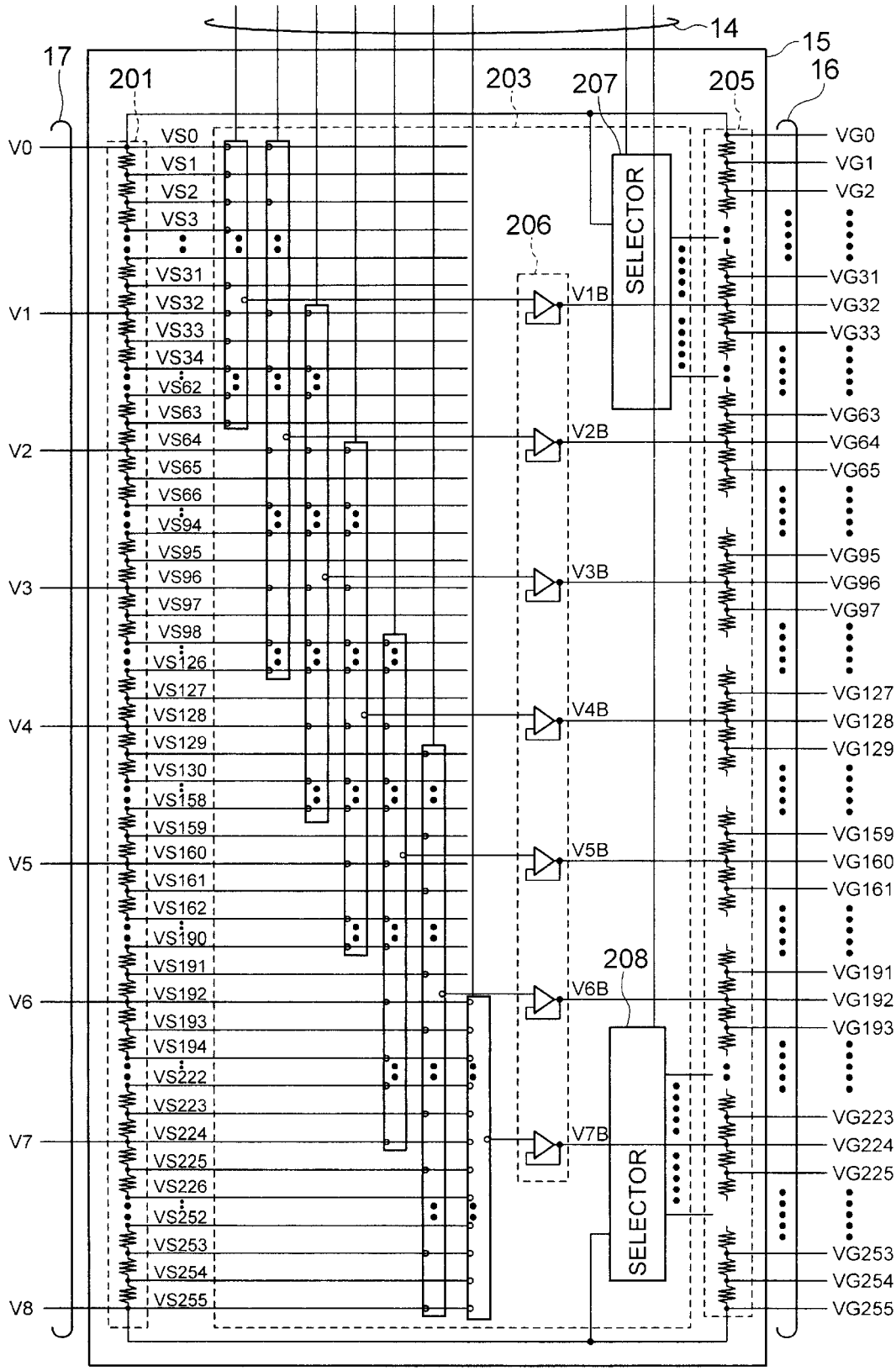
FIG. 6 is a diagram showing a configuration of a gray scale voltage generating circuit.
Figure 7:
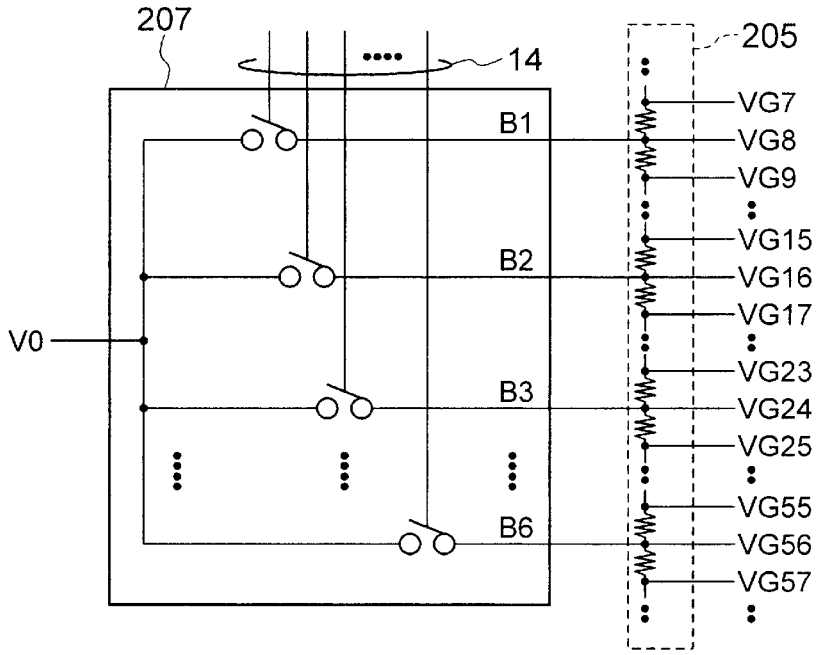
FIG. 7 is a diagram showing a configuration of a gray scale voltage generating circuit.
Figure 8:
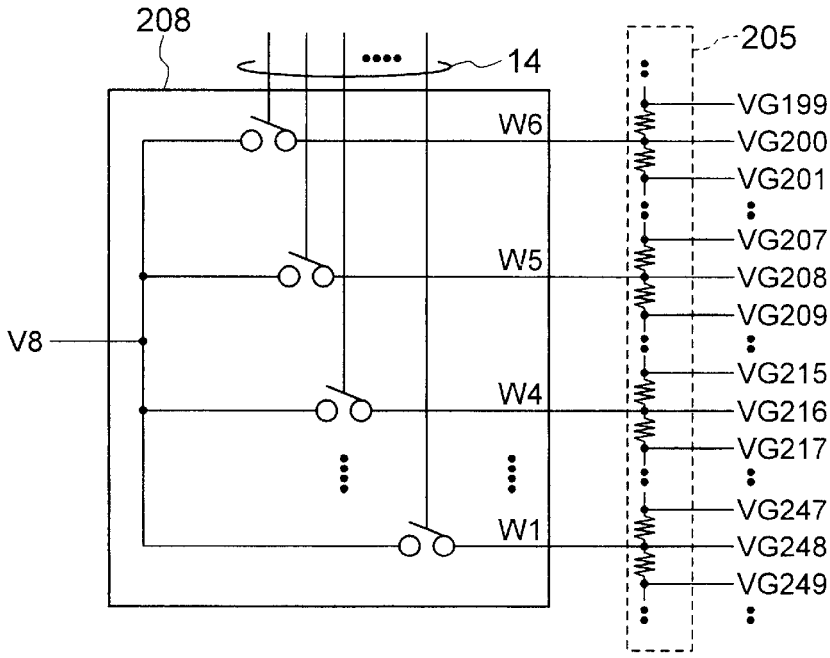
FIG. 8 is diagram showing a configuration of a gray scale voltage generating circuit.

FIGS. 2 and 3 are diagrams showing AC polarities of the liquid crystal panel of dot inversion drive type, FIG. 4 a diagram showing the drive timing of the liquid crystal display, FIG. 5 a diagram showing a configuration of the gray scale voltage generating circuit, and FIGS. 6, 7 and 8 diagrams showing a configuration of the select circuit of the gray scale voltage generating circuit. FIG. 9 is a diagram showing the specification of the gray scale control register, FIG. 10 a diagram showing a configuration of the data bus, FIG. 11 a diagram showing a register control circuit and the gray scale control register, FIG. 12 a diagram showing the write timing of the gray scale control register, FIGS. 13 to 18 diagrams showing the contents of the gray scale control, and FIGS. 19 and 20 diagrams showing a configuration of a liquid crystal controller.

As shown in FIG. 2, according to this embodiment, in order to perform the dot inversion drive with adjacent pixels at opposite AC polarities, the output terminals of the adjacent data drivers are opposite in polarity as shown in FIG. 3.

Now, the display operation of these component parts will be explained. In FIG. 1, the liquid crystal controller 1 receives the display signal group 100 from the system unit such as a personal computer not shown, and converts the signals to the timing of the data drivers 7-1 to 7-8 and the scanning driver 9 for driving the liquid crystal. The liquid crystal controller 1, in order to display $2^N$ gray scale levels (N: positive integer) (256 gray scale levels of RGB), transfers the display data using the 48-bit data bus serially with N bits (8 bits) of each of RGB in two parallel pixels. In the data drivers 7-1 to 7-8, the display data are sequentially retrieved, two pixels of RGB each time, with the data retrieval clock 2. The timing of the data retrieval is explained with reference to FIGS. 1 and 4. The display data 5 transferred in synchronism with the data retrieval clock 2 are such that a valid data start signal 3 is output by the liquid crystal controller 1 at a timing validating the display data, and the data driver 7-1 in the first stage begins to retrieve the display data. The data driver 7-1 retrieves the display data, 2 pixels of RGB each time, and completely retrieves the display data for 480 outputs with 80 clocks. The data driver 7-1, at the end of retrieval of the display data in its own stage, outputs the valid data start signal 31-1 to the data driver 7-2 in the next stage, so that the data driver 7-2 starts to retrieve the display data. The data drivers 7-2 to 7-8 repeat a similar operation. In this way, a line of display data is retrieved by the data latch circuit A22.

A line of the display data of the data latch circuit A22 are all latched at the data latch circuit B24 with the data horizontal sync signal 4. The gray scale voltage 16 corresponding to the output data of each output and the AC signal 19 is selected in the gray scale voltage select circuit 26 and buffered in the output buffer circuit 28, so that a line of the gray scale drive voltages 19-1 to 29-8 are output at the same time.

The scanning driver 9, on the other hand, selects the first gate line in synchronism with the scanning horizontal sync signal CL3 at the timing of the frame sync signal FLM generated in the liquid crystal controller 1. The second gate line and the third gate line are sequentially selected in synchronism with the scanning horizontal sync signal CL3. A total of 1024 lines are sequentially selected by the 1024 clocks of the scanning horizontal sync signal CL3. Upon validation of the next frame sync signal FLM, the first gate line is selected. By repeating the operation of selecting 1024 lines for each frame period in this way, the sequential line select operation is performed. The gray scale drive voltages 29-1 to 29-8 are output to the data line of the liquid crystal panel 10 by the data drivers 7-1 to 7-8 thereby to realize the display corresponding to the display data.

Now, the gray scale control operation will be explained. The gray scale voltage 16 is generated in such a manner that $2^N$ (256) levels of positive gray scale voltage and $2^N$ (256) levels of negative gray scale voltage are generated by the gray scale voltage generating circuit 15 from 9 levels V0 to V8 of the positive gray scale reference voltage 17 and 9 levels V9 to V17 of the negative gray scale reference-voltage 18 generated in the power circuit 8. FIGS. 5, 6, 7 and 8 are diagrams showing an internal configuration of the gray scale voltage generating circuit 15, in which numerals 201-1, 201-2 designate positive and negative reference voltage generating circuits, respectively, and numerals 202-1, 202-2 select reference voltages generated from the positive and negative reference voltages 17, 18, respectively, each at 256 levels VS0 to VS255 of the positive and negative reference voltages. Numerals 203-1, 203-2 designate circuits for selecting the reference voltages 202-1, 202-2, respectively, numerals 204-1, 204-2 gray scale generating reference voltages, and numerals 205-1, 205-2 gray scale voltage generating circuits for generating a gray scale voltage 16 of 256 gray scale levels (VG0 to VG255) for driving the liquid crystal panel from the gray scale generating reference voltages 204-1, 204-2, respectively.

Now, the operation of each circuit for generating the gray scale voltage will be explained. The reference voltage generating circuits 201-1, 201-2 are similar circuits having input reference voltages 17, 18 of different polarities, positive and negative. As shown in FIG. 6, the section between voltages V0 and V1 is divided by 32 thereby to generate the select reference voltages of 32 levels VS0 to VS31. In similar fashion, the section between V1 and V2 is divided by 32 thereby to generate the select reference voltages of 32 levels VS32 to VS63. This is also the case with the section between V2 and V8 from which the select reference voltages of 202-1 of 256 levels VS0 to VS255 are generated. Similarly, from the negative reference voltages 18 (V9 to V17), the select reference voltages 202-2 of 256 levels are generated in the reference voltage generating circuit 201-2. In the select circuits 203-1, 203-2, the gray scale voltage generating circuits 205-1, 205-2 perform the operation of selecting a reference voltage from the select reference voltages 202-1, 202-2 for generating the gray scale voltage.

In FIG. 6, the gray scale voltage generating circuit 205 generates a gray scale voltage by dividing the section between reference voltages V1B to V7B. The 32 levels VG0 to VG31 of the gray scale voltage are generated by dividing the section between the reference voltage V0 and the gray scale generating reference voltage V1B selected in the select circuit 203, by 32. The 32 levels VG32 to VG63 of the gray scale voltage are generated by dividing the section between the gray scale generating reference voltages V1B and V2B selected in the select circuit 203, by 32. In similar fashion, by dividing the section between V2B and V7B by 32, the gray scale voltages VG64 to VG223 are generated. The 32 levels VG224 to VG255 of the gray scale voltage are generated by dividing the section between the gray scale generating reference voltage V1B selected in the select circuit 203 and the reference voltage V8, by 32. The gray scale voltage generating circuit 205-2 also generates the negative gray scale voltages VG0 to VG255 in similar manner. As a result, the gray scale voltage can be controlled by controlling the selection of the gray scale generating reference voltages 204-1, 204-2 by the gray scale control signal in the select circuits 203-1, 203-2.

In FIG. 6, the buffer amplifier 206 buffers the selected voltage and connects the gray scale generating reference voltages V1B to V7B to the gray scale voltage generating circuit 205. For example, the gray scale generating reference voltage V1B is generated by selecting one of the 64 levels VS0, VS1 to VS63 of the select reference voltage. Also, the gray scale generating reference voltage V2B is generated by selecting one of the 64 levels VS0, VS2 to VS126 of the select reference voltage. In similar manner, the gray scale generating reference voltage V3B is generated by selecting one of the 64 levels VS32, VS34 to VS158 of the select reference voltage; the gray scale generating reference voltage V4B is generated by selecting one of the 64 levels VS64, VS66 to VS190 of the select reference voltage; the gray scale generating reference voltage V5B is generated by selecting one of the 64 levels VS98, VS100 to VS224 of the select reference voltage; the gray scale generating reference voltage V6B is generated by selecting one of the 64 levels VS129, VS131 to VS255 of the select reference voltage; and the gray scale generating reference voltage V7B is generated by selecting one of the 64 levels VS192, VS193 to VS255 of the select reference voltage.

Numerals 207, 208 in FIG. 6 designate circuits for selecting the reference voltages V0, V8, respectively. The internal configuration of these circuits is shown in FIGS. 7 and 8. In FIG. 7, the gray scale voltages VG8, VG16, VG24, VG40, VG48, VG56 of the gray scale voltage generating circuit 205 are connected to B1 to B6, respectively, and the reference voltage V0 is connected to a voltage-dividing point where the select switch is validated by the select signal 14. Similarly in FIG. 8, the gray scale voltages VG200, VG208, VG216, VG232, VG240, VG248 of the gray scale voltage generating circuit 205 are connected to W6 to W1, respectively, and the reference voltage V8 is connected to a voltage-dividing point where the select switch is validated by the select signal 14. By these select circuits 207, 208, the low gray scale area of the gray scale voltage generating circuit 205 is fixed to the voltage level of the reference voltage V0, and the high gray scale area thereof to the voltage level of the reference voltage V8.

Figure 10:
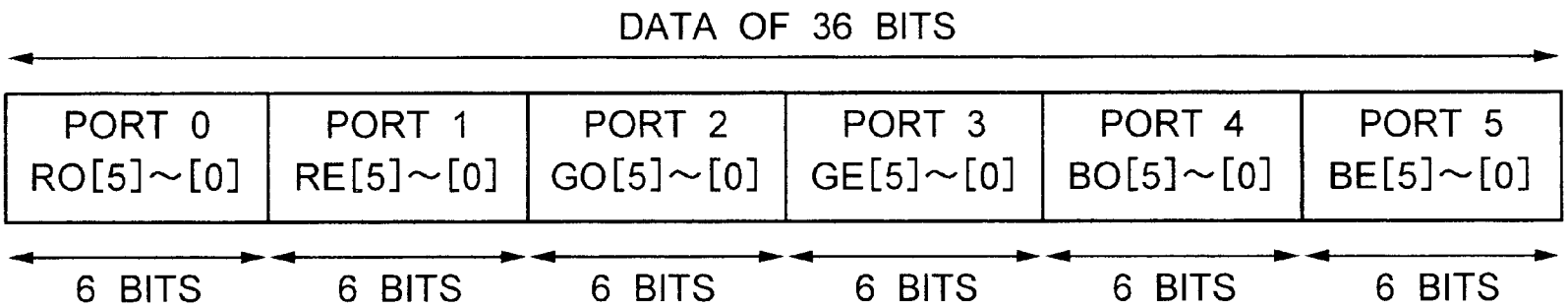
FIG. 10 is a diagram showing a bit assignment of a data bus.

Now, the configuration and operation of the gray scale control register will be explained. The set data from the liquid crystal controller 1 are written in the gray scale control register 13 using 36 bits of the 48-bit data bus. FIG. 9 shows a bit structure of the gray scale control register, and FIG. 10 a bit structure of the data bus. As shown in FIG. 9, the gray scale control register includes ten 6-bit registers, i.e. registers Nos. 1 to 9 for setting B1 to B6, W1 to W6 and V1B to V7B, and a control register No. 10. As shown in FIG. 10, 36 bits including RO[5:0], RE[5:0], GO[5:0], GE[5:0], BO[5:0], BE[5:0] out of 48 bits including RO[7:0], RE[7:0], GO[7:0], GE[7:0], BO[7:0], BE[7:0] representing 2 pixels of 8 bits each of RGB on the data bus are assigned to ports 0 to 5. The control register is assigned to port 5, and the other registers to port 0 to port 4 shown in FIG. 9. Whether the write operation of each gray scale control register is valid or invalid is determined by the bits P0 to P4 of the control register, and the gray scale control registers assigned to the same port are selected by the bit RS. This register configuration can set all the gray scale control registers in two write operations.

Figure 11:
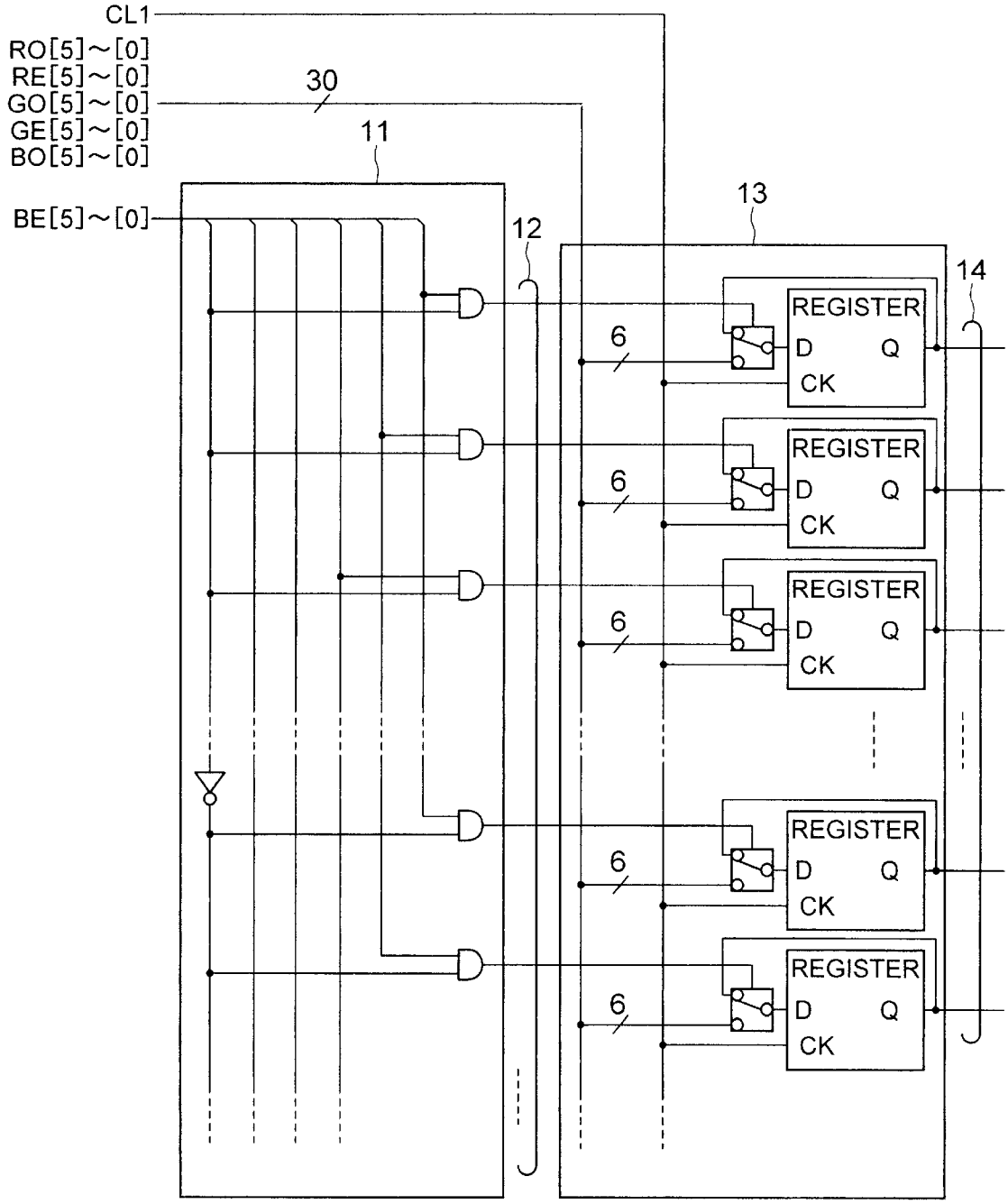
FIG. 11 is a diagram showing a configuration of a gray scale control register.

Now, the write operation and the circuit configuration of the gray scale control registers will be explained. FIG. 11 is a diagram showing a circuit configuration of the gray scale control registers and FIG. 12 a write timing chart. The data bus, which transfers the display data, can be shared by retrieving the data at the leading edge of the data horizontal sync signal 4 during the horizontal flyback period in which the transfer of the display data is not valid.

In this way, the gray scale control registers can be set without increasing the number of the input terminals of the data driver. Also, as shown in FIG. 11, 30 bits on the data bus assigned to ports 0 to 4 10 are connected to the 9 gray scale control registers, and the write operation of the gray scale control registers can be realized by validation according to the conditions of the bits P0 to P4 and RS of the control register of port 5.

As described above, by writing the set data in the gray scale control registers and thus setting the gray scale generating reference voltage of the gray scale voltage generating circuit, the gray scale control operation free of gray scale irregularities can be realized as in the data conversion control.

Now, the gray scale control realized by this invention will be explained with reference to FIGS. 13 to 18.

Figure 13:
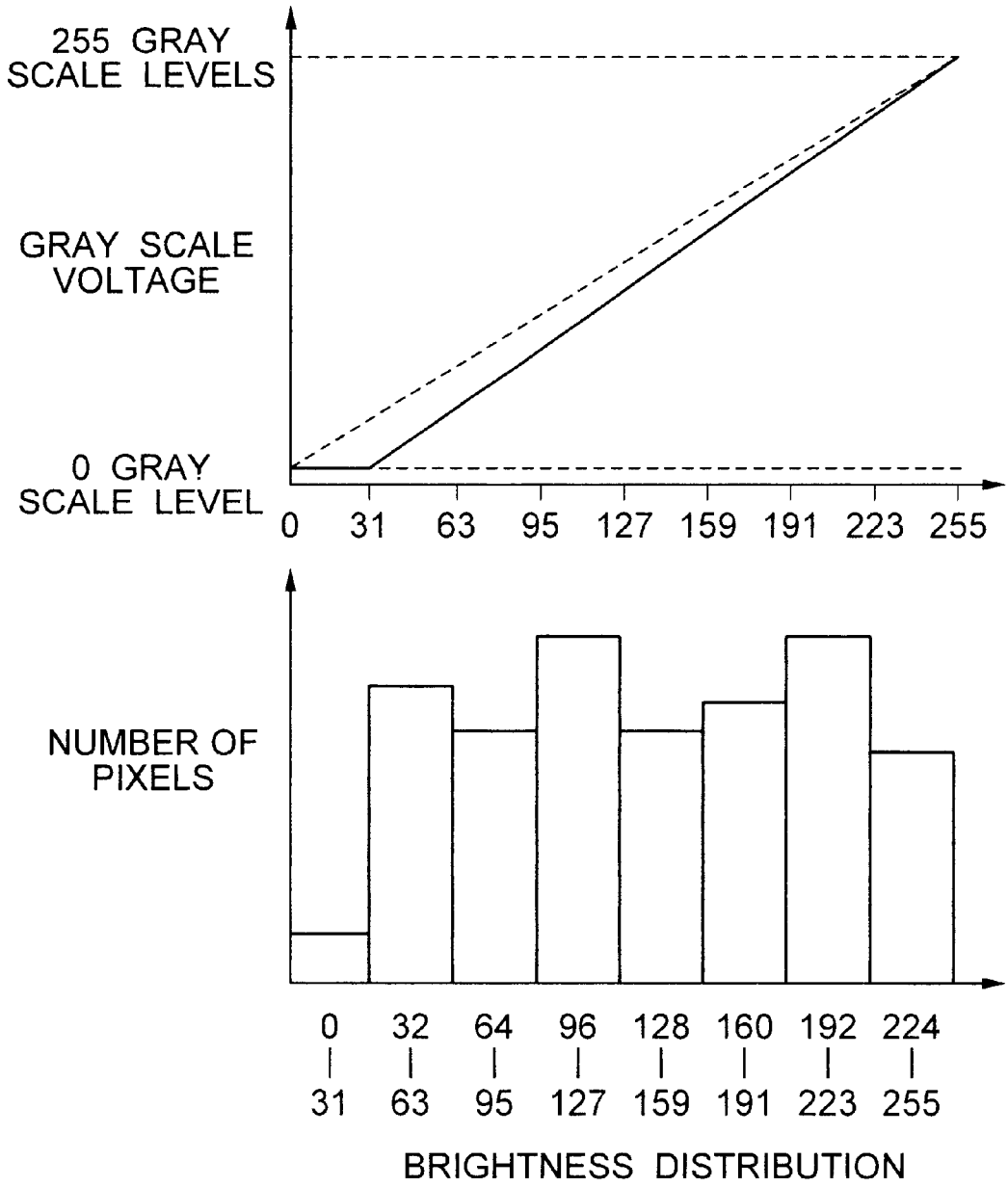
FIG. 13 is a diagram showing the histogram extension control.

FIG. 13 shows the gray scale control with the histogram extension control. The brightness distribution of gray scale levels 0 to 255 on the display screen is checked for each 32 gray scale levels. In the case where it is determined that the pixels of gray scale levels 0 to 31 are small in number, the contrast of gray scale levels 0 to 31 is decreased while the contrast of gray scale levels 32 to 255 is increased thereby to improve the contrast of the screen as a whole.

Figure 14:
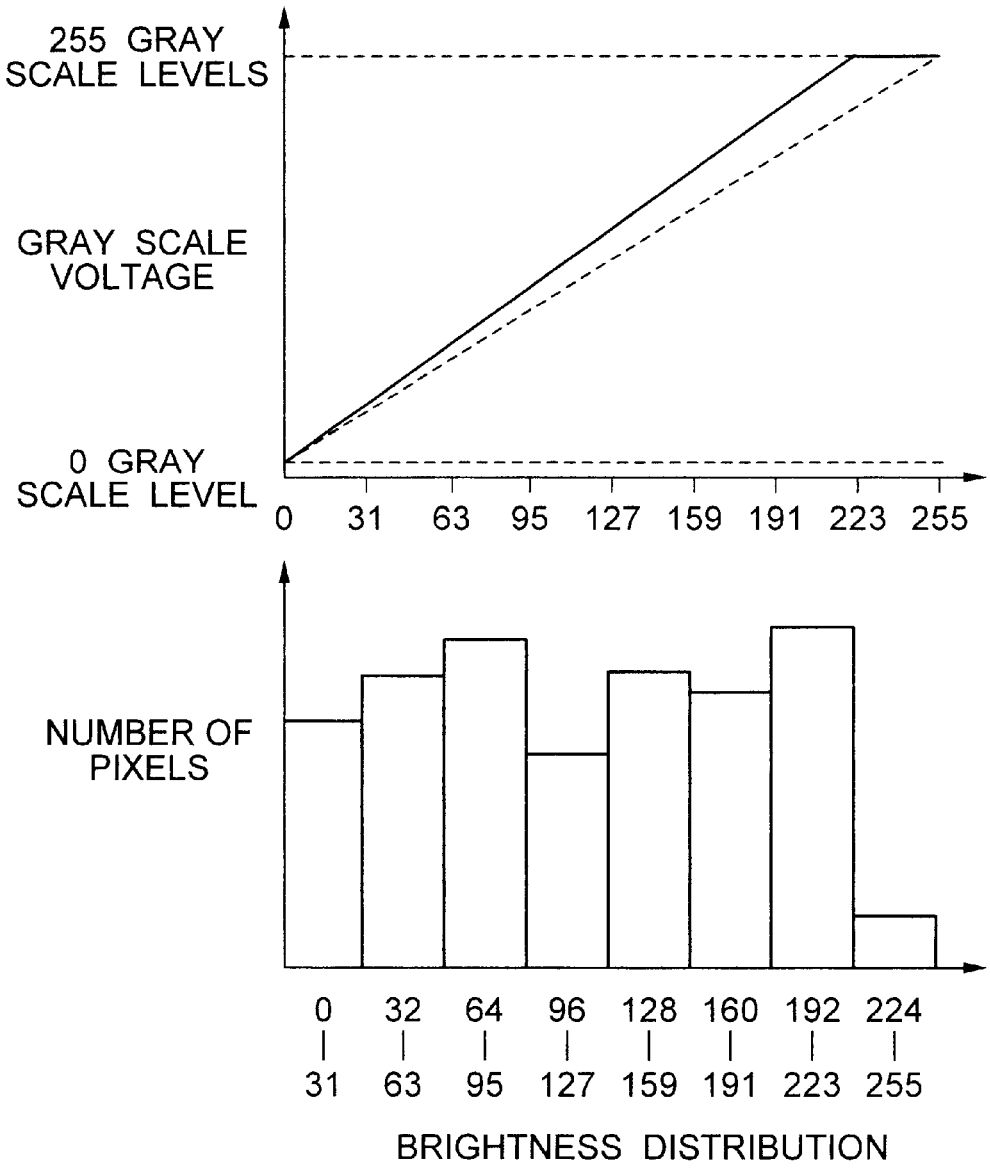
FIG. 14 is a diagram showing the histogram extension control.

Also, in FIG. 14, the brightness distribution of gray scale levels 0 to 255 on the display screen is checked for each 32 gray scale levels, and in the case where it is determined that the pixels of gray scale levels 224 to 255 are small in number, the contrast of gray scale levels 224 to 255 is decreased while the contrast of gray scale levels 0 to 223 is increased thereby to improve the contrast of the screen as a whole.

Figure 15:
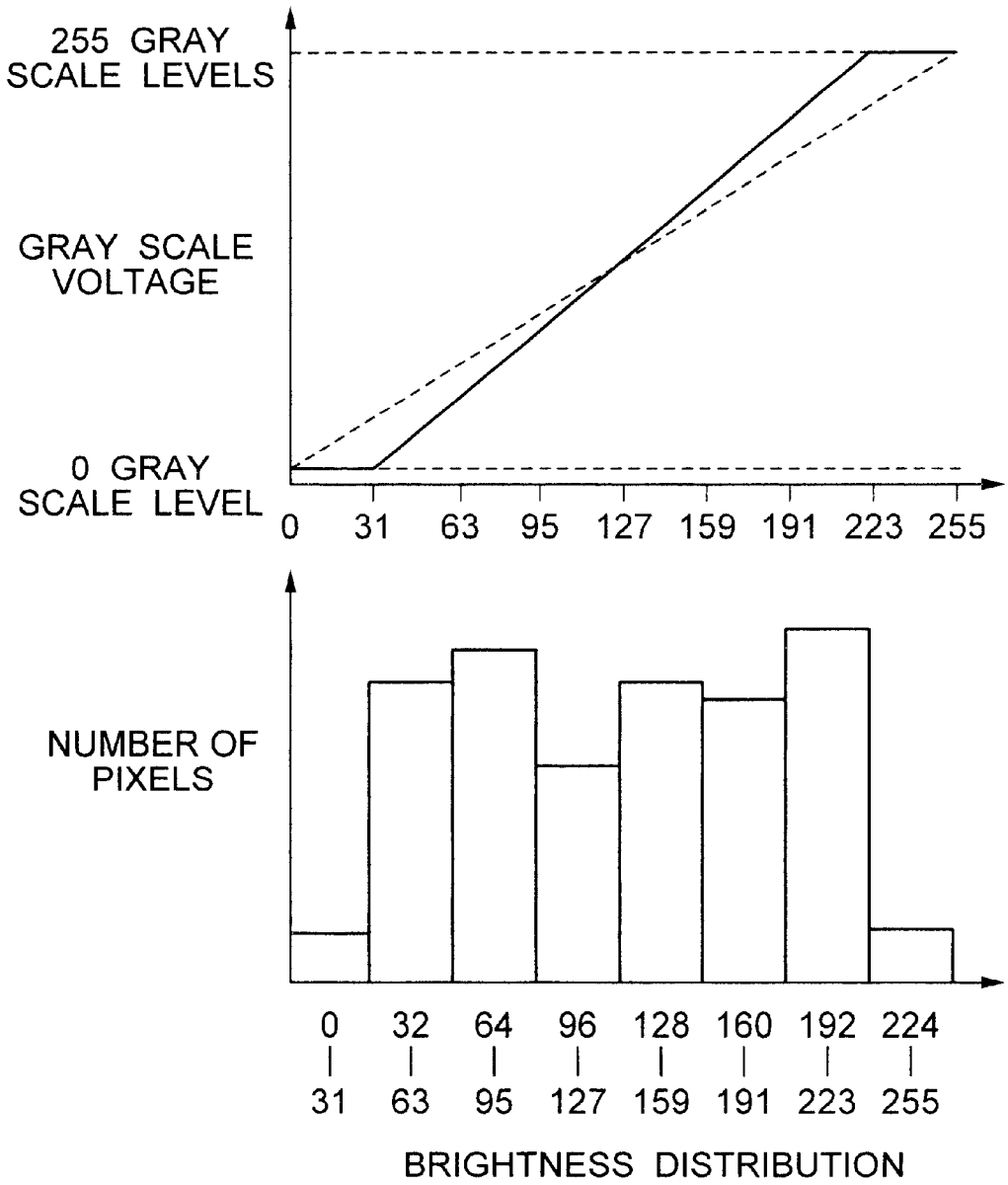
FIG. 15 is a diagram showing the histogram extension control.

In FIG. 15, on the other hand, the brightness distribution of gray scale levels 0 to 255 on the display screen is checked for each 32 gray scale levels, and in the case where it is determined that the pixels of gray scale levels 0 to 31 and gray scale levels 224 to 255 are small in number, the contrast of gray scale levels 0 to 31 and gray scale levels 224 to 255 is decreased while the contrast of gray scale levels 32 to 223 is increased thereby to improve the contrast of the screen as a whole.

In this way, the brightness distribution of the pixels on the display screen is checked by the histogram extension control, and in the case where the pixels in the low gray scale area or the high gray scale area are small in number, the contrast in the area having a small number of pixels is reduced, while the contrast in the area having a multiplicity of pixels is increased thereby to improve the contrast of the whole screen. The brightness distribution may alternatively be checked for either the pixels of one screen or the pixels of one line.

According to this embodiment, in order to improve the contrast of the whole screen, the gray scale level of the display data itself is not converted, but the gray scale generating reference voltage for generating the gray scale voltage is converted thereby to generate the gray scale voltage.

Specifically, in order to perform the histogram extension control, the histogram for each frame is set in the register 13 as a correspondence relationships between the liquid crystal display data and the liquid crystal gray scale voltage. In the gray scale voltage generating circuit 16, reference voltages of 256 levels are generated from the reference voltages 17, 18 supplied from the power circuit 8, and based on the correspondence stored in the register 13, a gray scale generating reference voltage replacing the reference voltages 17, 18 supplied from the power circuit 8 is determined. Specifically, in the case of FIG. 13, in order to linearly change the gray scale levels 32 to 255, the gray scale generating reference voltages V1B to V7B are set. For example, the gray scale voltage is required to be set to 0 for the gray scale levels 0 to 31. Therefore, the gray scale generating reference voltages V1B and V2B are both set to 0, and required to be determined in such a manner as to increase the voltage uniformly in the remaining section between V3B and V7B so that the gray scale voltage linearly changes from 0 to 255. In similar fashion, in FIG. 14, the gray scale generating reference voltage is determined in such a manner that the gray scale voltage corresponding to 255 gray scale levels is obtained between gray scale levels 223 and 255 and the remaining gray scale levels linearly changes. Also in FIG. 15, the gray scale generating reference voltage is determined in such a manner as to obtain the gray scale voltage shown in the gray of FIG. 15.

In the examples shown in FIGS. 13 to 15, the brightness distribution is checked for each 32 gray scale levels. By checking the brightness distribution for each 16 or each 8 gray scale levels, however, a more detailed histogram extension control becomes possible and a high image quality can be realized.

Also, the histogram extension control according to this embodiment can be easily realized by checking the brightness distribution by the liquid crystal controller 1, and based on the result of the check, setting B1 to B6 and W1 to W6 of the gray scale control registers No. 1 and No. 2. In this way, the voltage in the low gray scale area or the high gray scale area can be fixed to V0 (VG0) and V8 (VG255) for each 8 gray scale levels.

Figure 16:
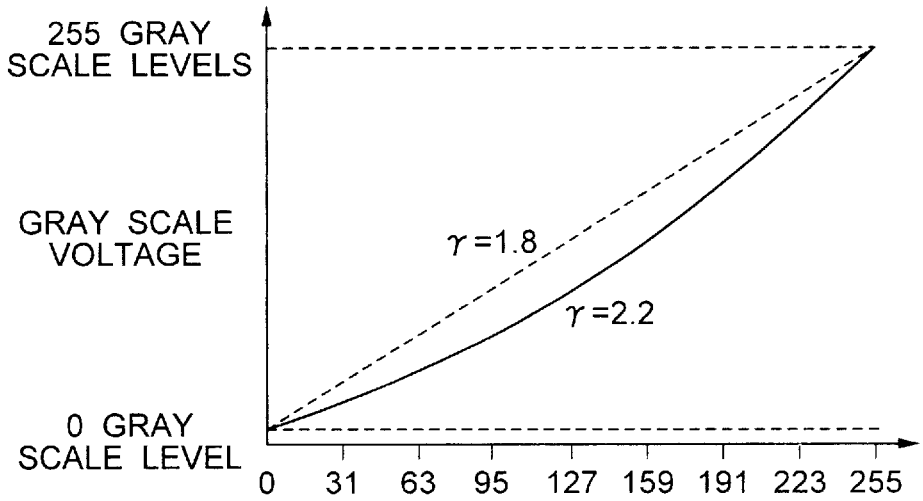
FIG. 16 is a diagram showing the gamma curve control.
Figure 17:
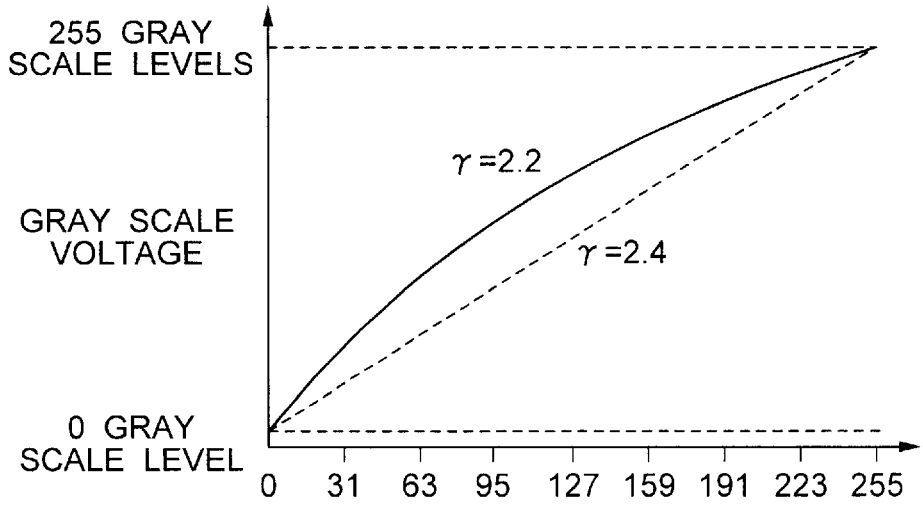
FIG. 17 is a diagram showing the gamma curve control.

Now, the gray scale control operation with the gamma curve control will be explained with reference to FIGS. 16 and 17. FIG. 16 shows the gray scale control operation for controlling the gamma curve of $\gamma=1.8$ to that of $\gamma=2.2$. Generally, with the increase in the gamma coefficient of the gamma curve, the contrast in the high gray scale area increases, whereas with the decrease in the gamma coefficient, the contrast of the low gray scale area increases. Based on the brightness distribution shown in FIGS. 13, 14 and 15, the gray scale control register is set in such a manner that the gamma coefficient is increased in the case where the pixel distribution of the high gray scale area is high, whereas the gamma coefficient is decreased in the case where the pixel distribution of the low gray scale area is high. Also, the high image quality display is realized by inverted gamma transformation of the display data not subjected to gamma transformation. FIG. 16 shows an example of gray scale control operation for transforming the gray scale curve of the gamma coefficient $\gamma=1.8$ to that of the gamma coefficient $\gamma=2.2$. FIG. 17, on the other hand, shows a gray scale control operation for transforming the gray scale curve of the gamma coefficient $\gamma=2.4$ to that of the gamma coefficient $\gamma$32 2.2.

As described above, the gamma curve control operation improves the contrast and appearance of the whole screen by controlling the gamma curve in the case where the optimum gamma curve is different between the animation display such as TV broadcast or DVD and the display of a text or a document for OA applications.

Also, according to this embodiment, the gamma curve control operation is performed to determine whether the video signal input to the liquid crystal controller 1 is the animation display for TV broadcast or DVD or whether it is the display of a text or a document for OA applications. Based on the result of this determination, the gray scale control registers Nos. 3 to 9 are set thereby to set the gray scale generating reference voltages V1B to V7B. An arbitrary gamma curve can be set easily in this way by the gray scale control of the gamma curve.

Now, the equalize extension control will be explained with reference to FIG. 18.

Figure 18:
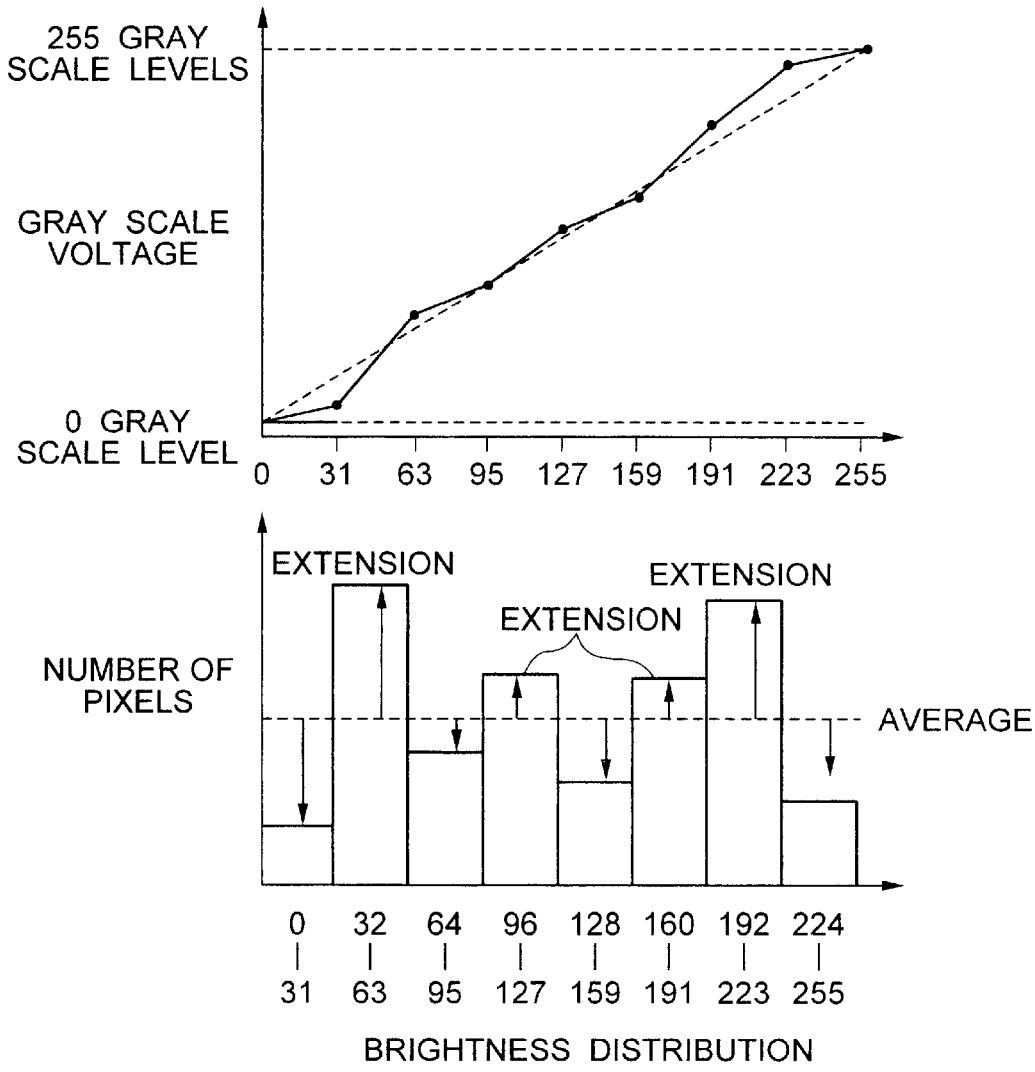
FIG. 18 is a diagram showing the equalize control.

FIG. 18 shows the gray scale control with the equalize extension control to check the brightness distribution of gray scale levels 0 to 255 of the display screen for each 32 gray scale levels, in which by increasing the contrast of the gray scale area with the number of distributed pixels greater than the average number of distributed pixels, the contrast of the whole screen is improved. For the gray scale areas 32 to 63 where the number of pixels is greater than the average number of pixels, the contrast is increased. For the gray scale areas 128 to 159 where the number of pixels is smaller than the average number of pixels, on the other hand, the contrast is decreased. In this way, by increasing or decreasing the contrast in accordance with the pixel distribution of each gray scale area, the contrast and appearance of the whole screen can be improved.

As described above, the equalize extension control operation is performed in such a manner that the brightness distribution of the pixels on the display screen is checked, and the contrast in the area with a small number of pixels is reduced, whereas the contrast is increased for the area having many pixels thereby to improve the contrast of the whole screen.

Also, in the equalize extension control according to this embodiment, the brightness distribution is checked by the liquid crystal controller 1, and based on the result of the check, the gray scale control registers Nos. 3 to 9 are set, thereby setting the gray scale generating reference voltages V1B to B7B. In this way, the contrast control can be easily set for each gray scale area.

Figure 19:
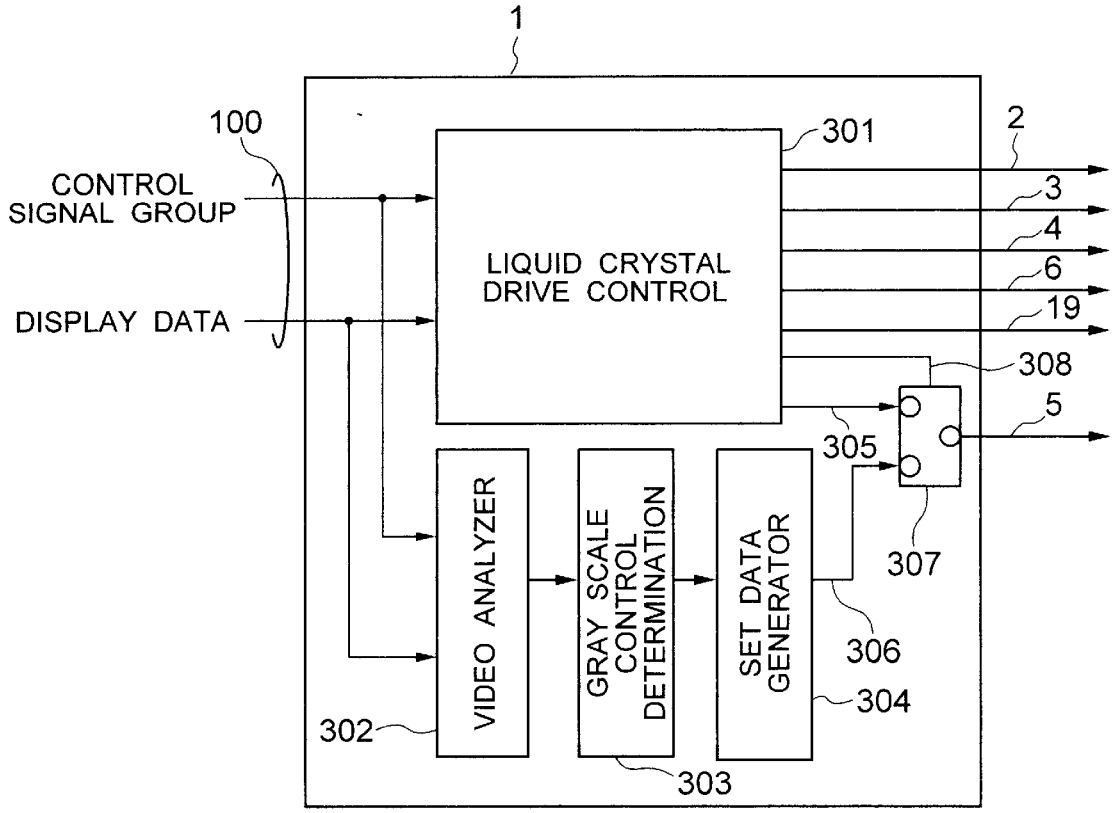
FIG. 19 is a diagram showing a configuration of a liquid crystal controller.

Now, the configuration of the liquid crystal controller for performing the gray scale control described above will be explained with reference to FIGS. 19 and 20. In FIG. 19, numeral 301 designates a liquid crystal drive control circuit for generating a data sync clock 2, a valid data start signal 3, a data horizontal sync signal 4 and an AC signal 19 from the display signal group 100 for driving a liquid crystal panel. Numeral 302 designates an image analysis circuit for analyzing the video information such as the brightness distribution (histogram), the average brightness and the gamma curve of the display data of the display signal group 100, and outputs the analysis data to the gray scale control determining circuit 303. The gray scale control determining circuit 303 determines the gray scale control based on the image analysis data, and the set data generating circuit 304 generates the set data 306 for setting the gray scale control in the gray scale control registers of the data drivers 7-1 to 7-8. The set data 306 and the display data 305 are switched by the select circuit 307 using the select signal 308 at the timing shown in FIG. 12, thereby making it possible to share the data bus.

According to this embodiment, in order to improve the contrast of the whole screen, not the gray scale level of the display data itself but the gray scale generating reference voltage for generating the gray scale voltage is converted, and based on this, the gray scale voltage is generated.

Specifically, in order to perform the equalize extension control operation, the number of pixels is counted for each plurality of brightness areas in a frame of display data thereby to prepare a histogram, and the difference between the average number of distributed pixels counted for each plurality of brightness areas and the number of pixels distributed in each brightness area counted is set in the register 13 as a correspondence relationships between the liquid crystal display data and the liquid crystal gray scale voltage. In the gray scale voltage generating circuit 16, a reference voltage of 256 levels is generated from the reference voltages 17, 18 supplied from the power circuit 8, and based on the correspondence stored in the register 13, a gray scale generating reference voltage replacing the reference voltages 17, 18 supplied from the power circuit 8 is determined. In this way, the gray scale control operation can be performed for each animation frame or image scene by analyzing the image with the liquid crystal controller and changing the setting of the gray scale control register of the data driver.

Figure 20:
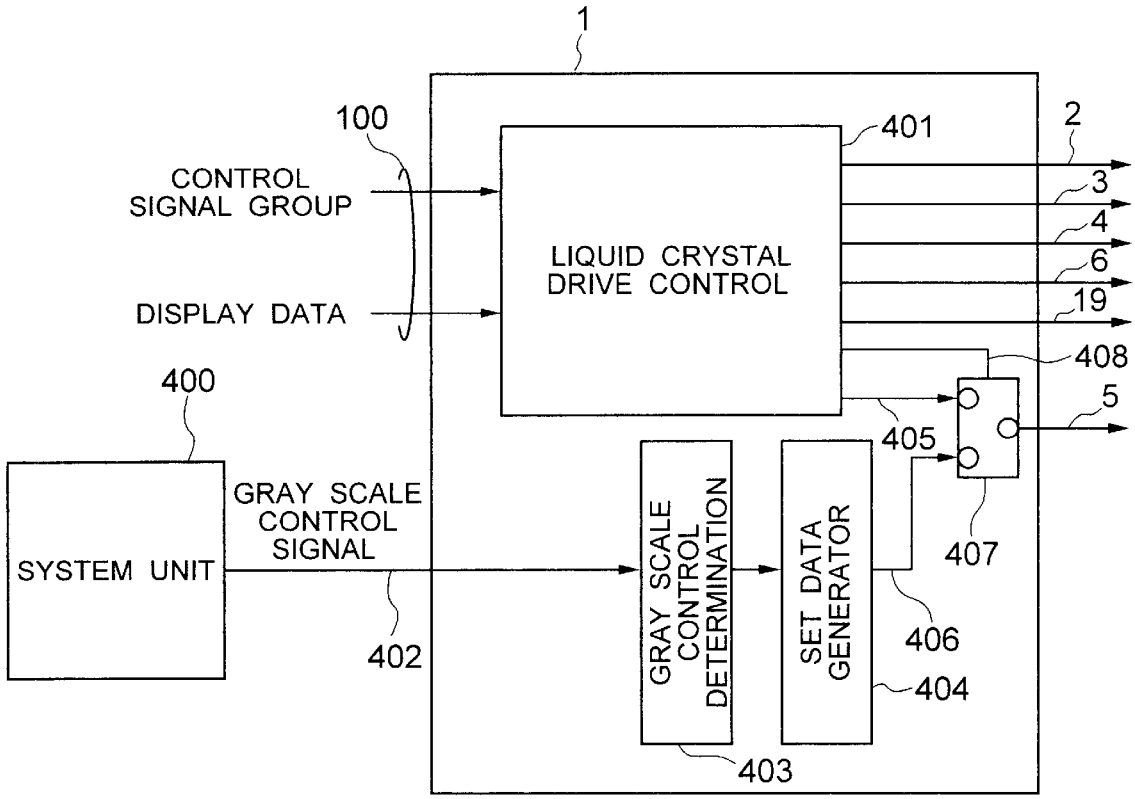
FIG. 20 is a diagram showing a configuration of a liquid crystal controller.

FIG. 20 shows a configuration associated with the case in which the image is analyzed in a system unit other than the liquid crystal controller and the gray scale control signal is transferred to the liquid crystal controller thereby to generate the set data of the gray scale control register in the liquid crystal controller. In FIG. 20, numeral 401 designates a liquid crystal drive control circuit for generating a data sync clock 2, a valid data start signal 3, a data horizontal sync signal 4 and an AC signal 19 for driving the liquid crystal panel from the display signal group 100. Numeral 400 designates a system unit such as a personal computer, which transfers to the liquid crystal controller 1 a gray scale control signal 402 for giving an instruction on the gray scale control based on the brightness distribution (histogram) of the image to be displayed, the average brightness thereof, the result of analysis of the gamma curve and the user set information. The liquid crystal controller 1, in response to the instruction of the gray scale control signal 402 from the system unit 400 in the gray scale control determining circuit 403, determines the gray scale control and the set data generating circuit 404 generates the set data 406 to be set in the gray scale control registers of the data drivers 7-1 to 7-8. The set data 406 and the display data 405 can share the data bus by switching the select circuit 407 with the select signal 408 at the timing shown in FIG. 12. In this way, the gray scale control can be performed for each animation frame or image scene by analyzing the image in the system unit and changing the setting of the gray scale control register of the data driver by the liquid crystal controller.

According to this embodiment, nine each of positive and negative reference voltages are set in a way corresponding to the display of 256 gray scale levels. The invention is not limited to this, however, but a similar gray scale control can be realized also in the case where five each of the positive and negative reference voltages are set. Also, according to the invention, instead of setting the gray scale generating reference voltages V1B to V7B for each 32 gray scale levels, they can be set for each 16 gray scale levels to realize the gray scale control in similar fashion.

Now, a second embodiment of the invention will be explained with reference to FIGS. 9 to 18 and FIGS. 21 to 29.

The second embodiment is different from the first embodiment in that the display of $2^N$ (256) gray scale levels is realized by the common inversion drive and the FRC control using the data driver of 64 gray scale levels.

Figure 21:
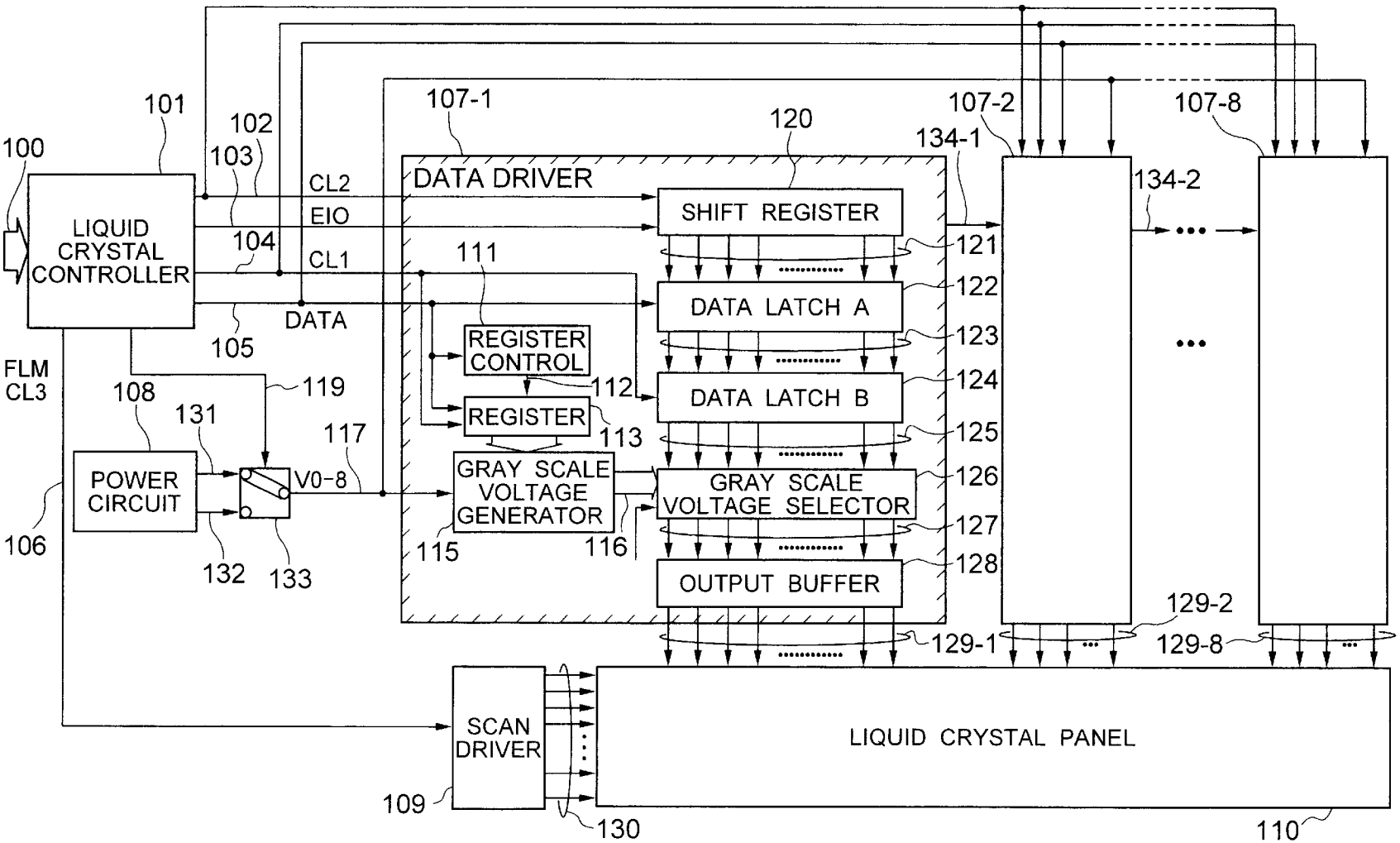
FIG. 21 is a block diagram showing a liquid crystal display apparatus according to an embodiment of the invention.

FIG. 21 is a diagram showing a configuration of a liquid crystal panel drive circuit according to this invention, in which the liquid crystal panel of 1280×RGB×1024 is used for the liquid crystal display of 256 gray scale levels for each of RGB for display of 1638400 colors by FRC control. Numeral 100 designates a display signal group transferred from the system unit, numeral 101 a liquid crystal controller for converting the display signal group 100 to a sync signal of the liquid crystal driver and display data, numeral 102 a data sync clock, numeral 103 a valid data start signal, numeral 104 a data horizontal sync signal, numeral 105 display data, numeral 106 a scanning driver control signal group, and numerals 107-1 to 107-8 data drivers with 64 gray scale levels and 480 outputs. The data drivers 107-1 to 107-8 drive a liquid crystal panel. Numeral 108 designates a power circuit for generating a positive reference voltage 131, a negative reference voltage 132, a positive common voltage 141 and a negative common voltage 142 of the gray scale voltage for driving the liquid crystal. Numeral 109 designates a scanning driver for scanning the liquid crystal, and numeral 110 a liquid crystal panel having a resolution of 1280×RGB×1024. Numeral 111 designates a register control circuit, numeral 112 a register control signal group for controlling the register 113, and numeral 114 a register output signal for controlling the gray scale voltage generating circuit 115. Numeral 116 designates a gray scale voltage signal group having 64 gray scale levels for each of positive and negative voltages generated in the gray scale voltage generating circuit 15, and numeral 119 an AC signal for controlling the polarity of the alternating current. Numeral 133 designates a switching circuit for switching the positive reference voltage 131 and the negative reference voltage 132 with the AC signal 119. Numeral 143 designates a switching circuit for switching the positive common voltage 141 and the negative common voltage 142 with the AC signal 119. Numeral 120 designates a shift register, numeral 122 a data latch circuit for sequentially latching the display data 105 with the shift clock 121 generated in the shift register 120. Numeral 124 designates a data latch circuit for latching all the output data 123 of the data latch circuit 122 at a time with the data horizontal sync signal 104. Numeral 126 designates a gray scale voltage select circuit for selecting the gray scale voltage from the gray scale voltage signal group 116 based on the output data 125 of the data latch circuit 124. Numeral 128 designates an output buffer circuit for outputting by buffering in the buffer circuit the select gray scale voltage 127 selected by the gray scale voltage select circuit 126. Numerals 129-1 to 129-8 designate gray scale drive voltages for driving the liquid crystal panel 110 of 1280×RGB×1024, and numeral 130 a scanning voltage.

Figure 22:
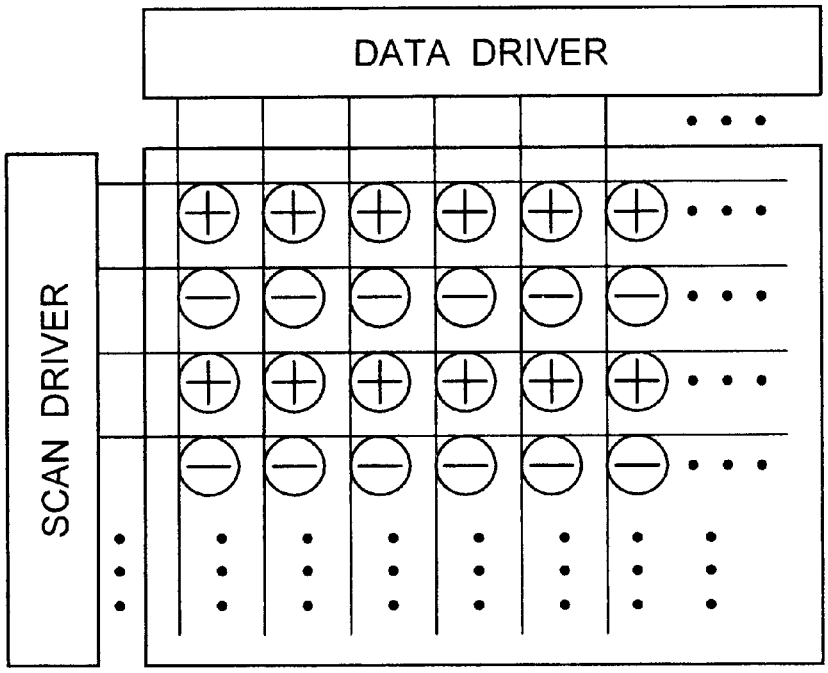
FIG. 22 is a diagram showing the dot inversion drive.
Figure 23:
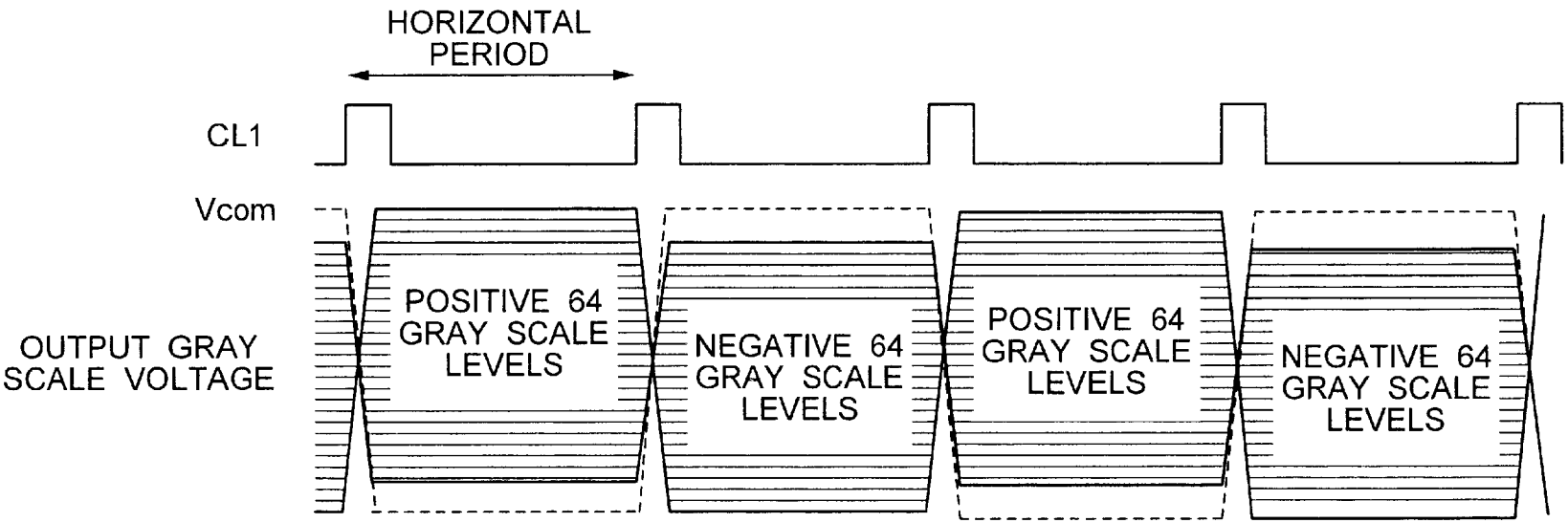
FIG. 23 is a timing chart of the dot inversion drive.
Figure 24:
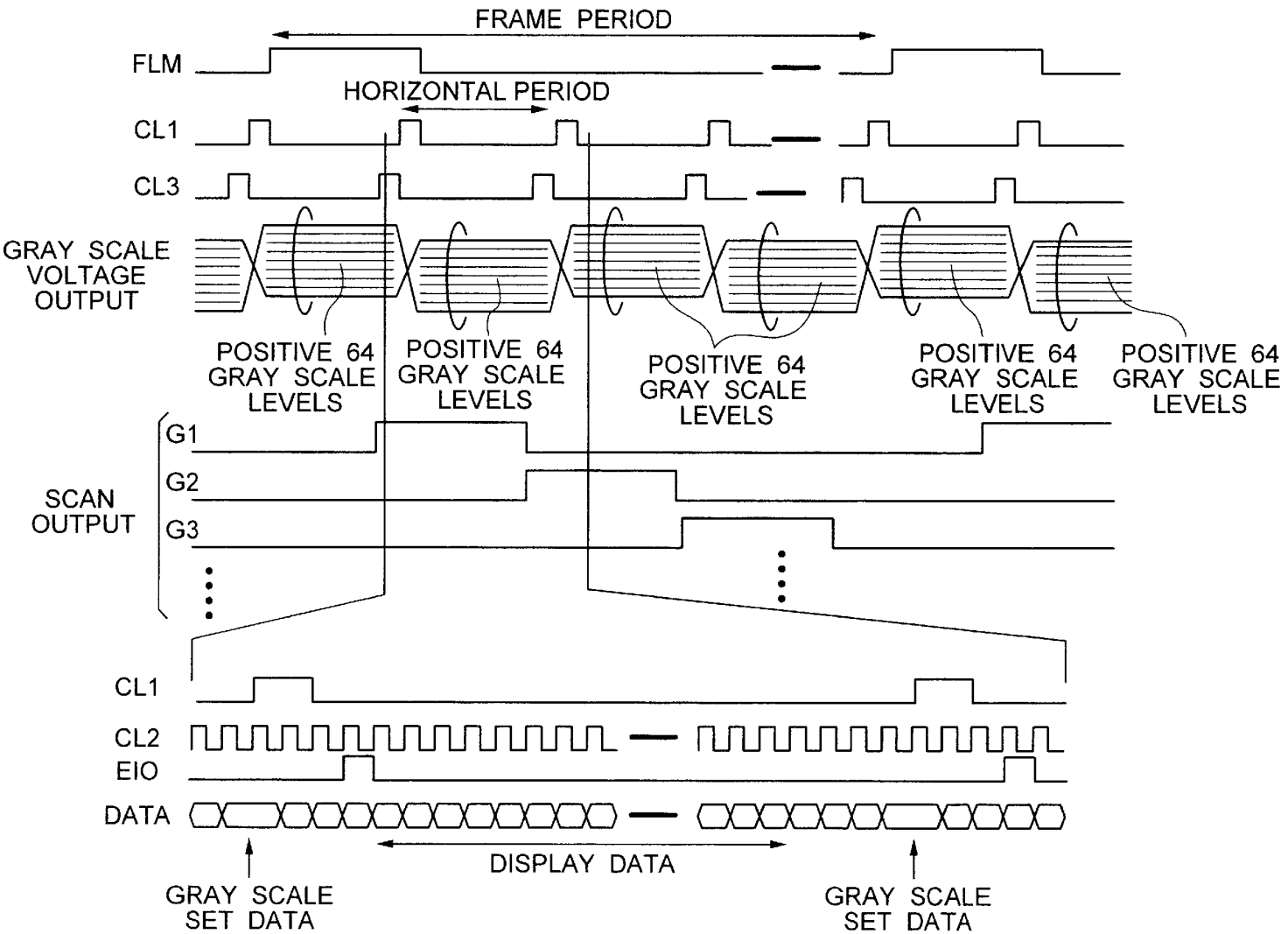
FIG. 24 is a diagram showing the drive timing of a liquid crystal display.
Figure 25:
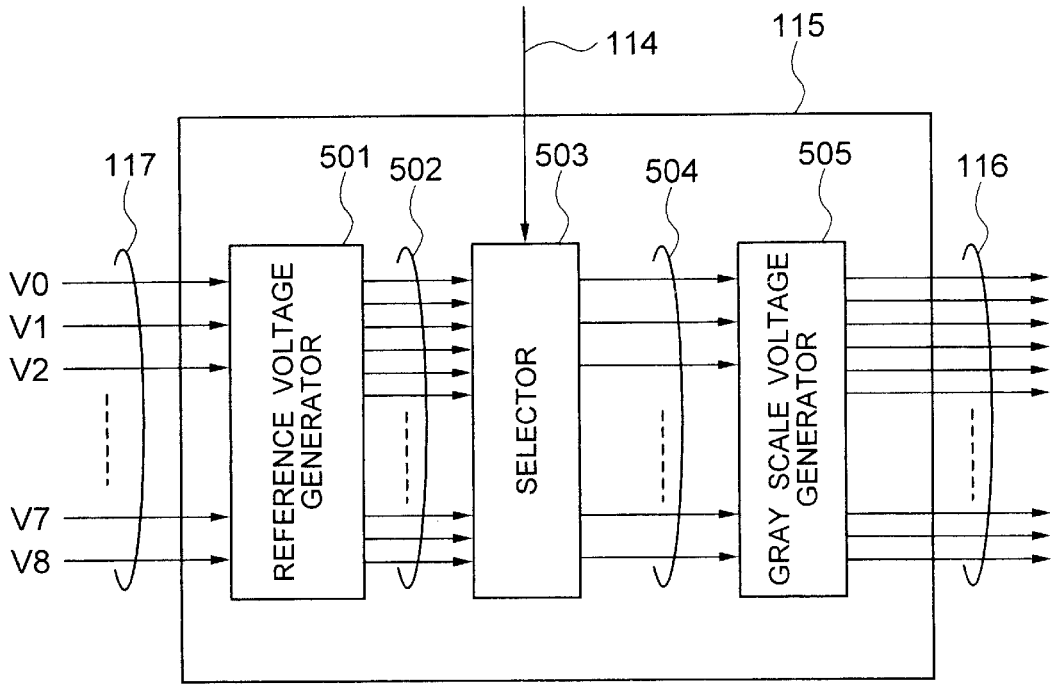
FIG. 25 is a diagram showing a configuration of a gray scale voltage generating circuit.
Figure 26:
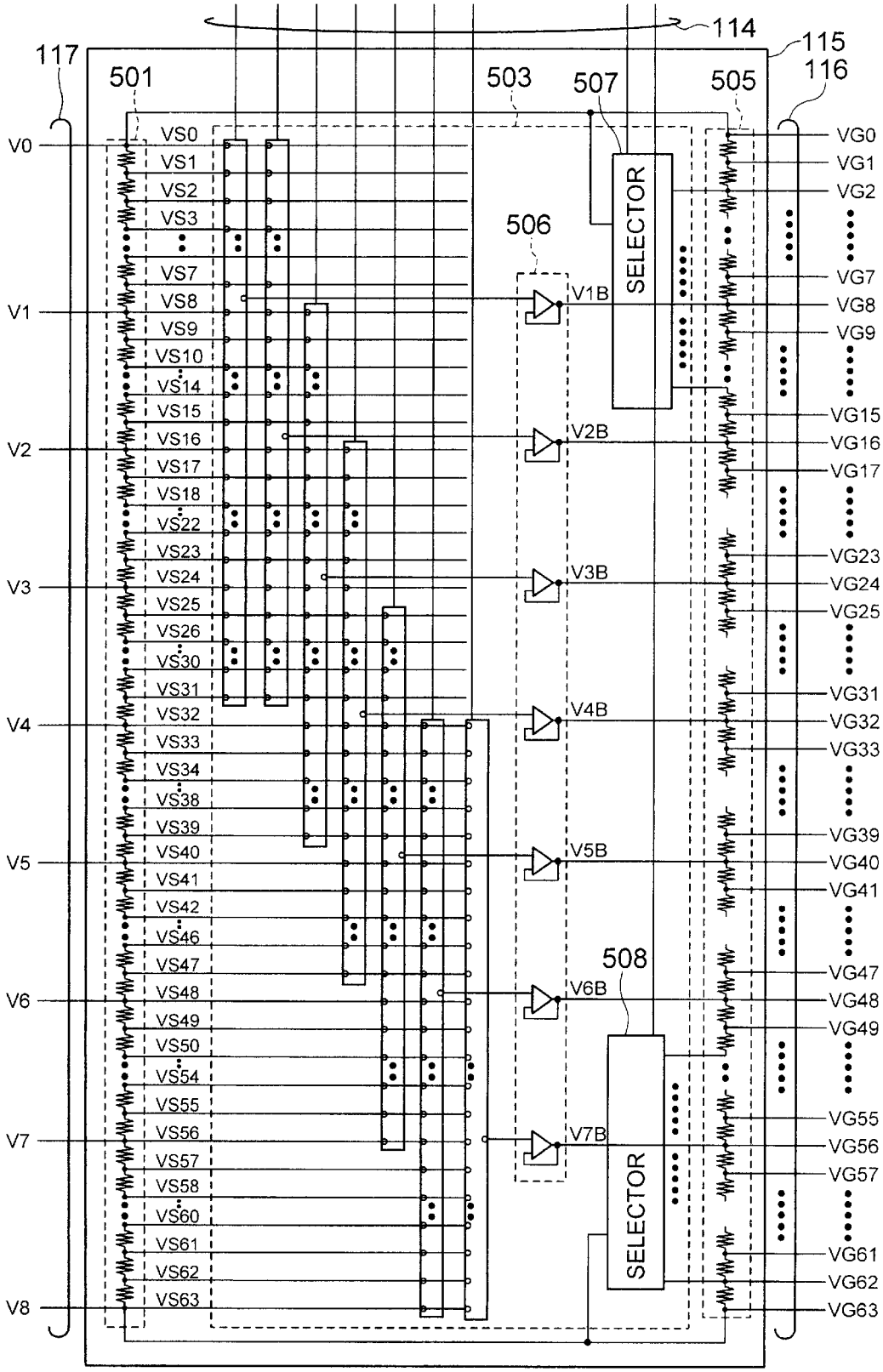
FIG. 26 is a diagram showing a configuration of a gray scale voltage generating circuit.
Figure 27:
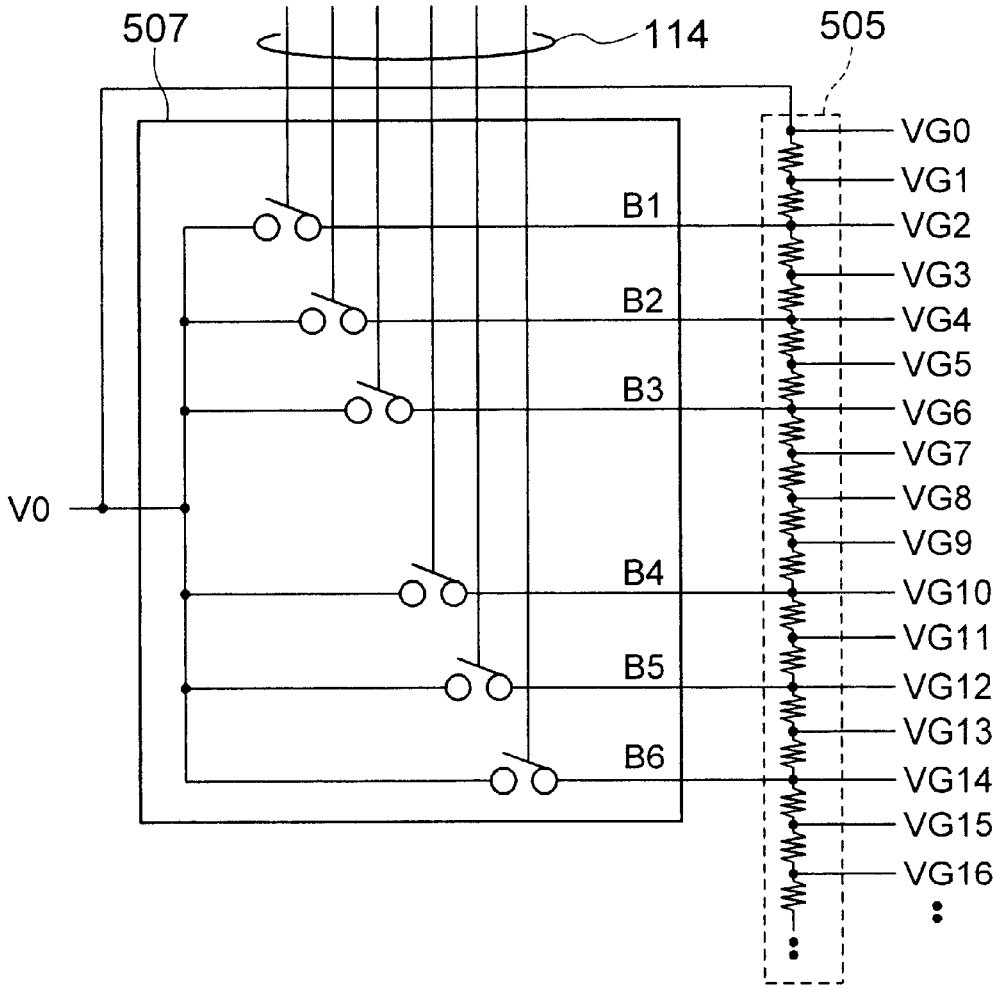
FIG. 27 is a diagram showing a configuration of a gray scale voltage generating circuit.
Figure 28:
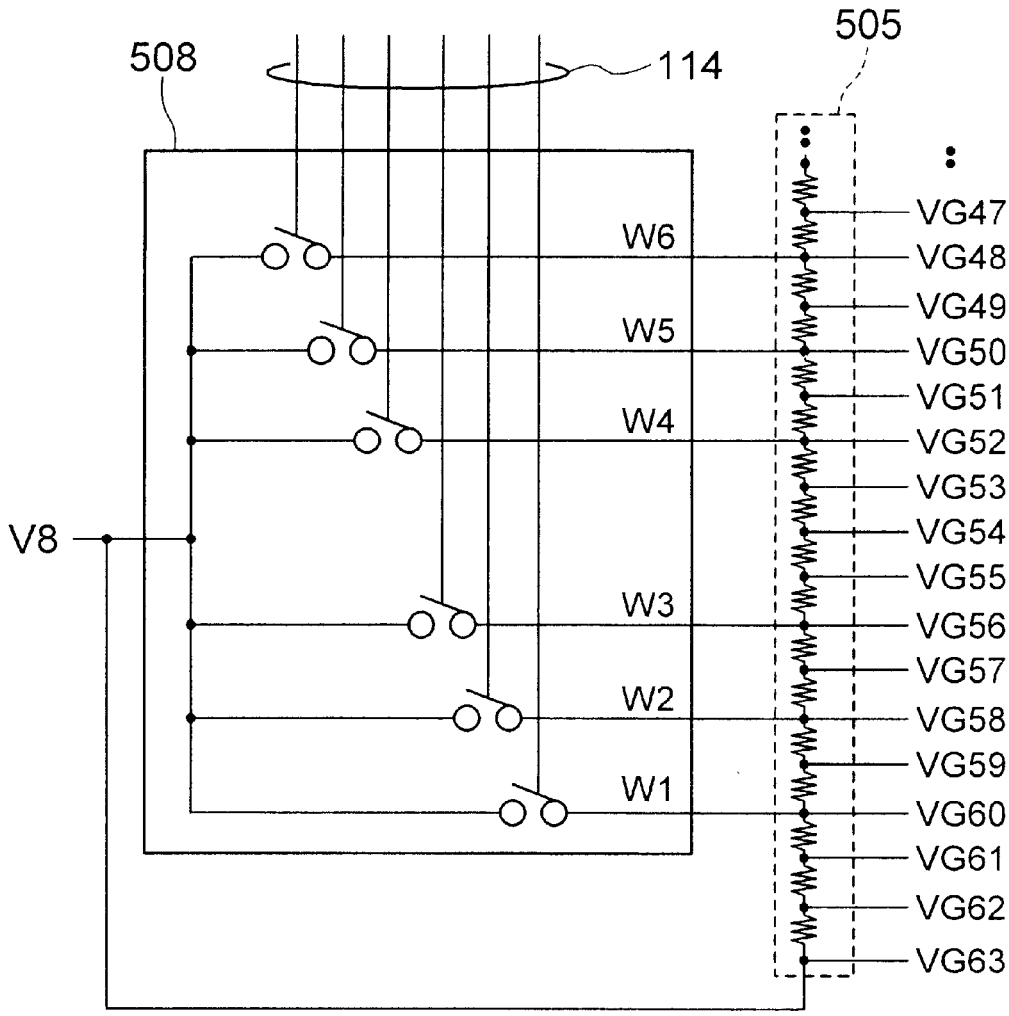
FIG. 28 is a diagram showing a configuration of a gray scale voltage generating circuit.
Figure 29:
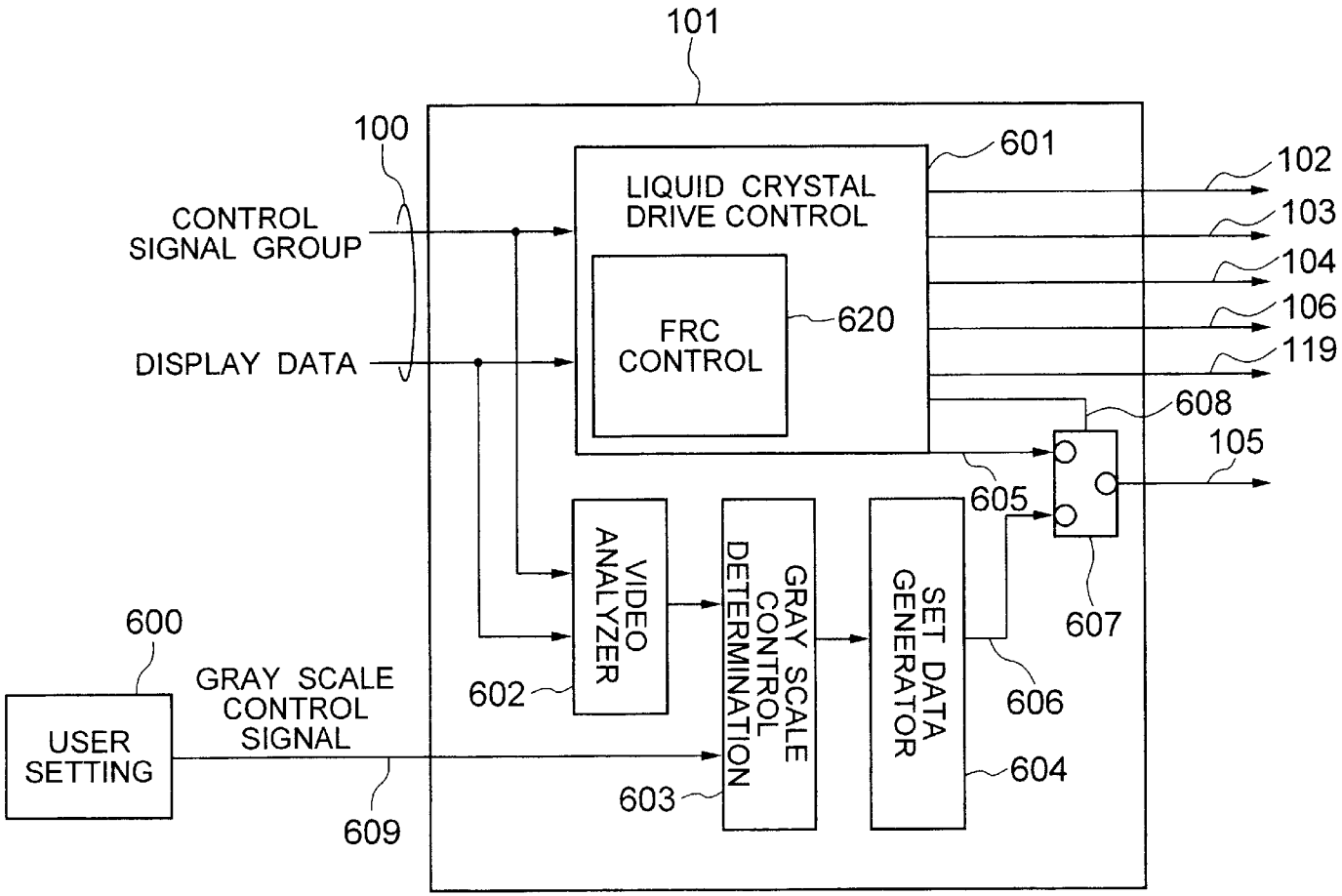
FIG. 29 is a diagram showing a configuration of a liquid crystal controller.

FIGS. 22 and 23 are diagrams showing the AC polarities of the liquid crystal panel of common inversion drive type, FIG. 24 a diagram showing the drive timing of the liquid crystal display, FIG. 25 a diagram showing a configuration of the gray scale voltage generating circuit, FIGS. 26, 27, 28 diagrams showing a configuration of the select circuit of the gray scale voltage generating circuit, and FIG. 29 a diagram showing a configuration of the liquid crystal controller.

As shown in FIG. 22, according to this embodiment, the common inversion drive is effected in which the pixels on the same line have the same AC polarity while the pixels on adjacent lines have opposite AC polarities. Therefore, as shown in FIG. 23, adjacent lines have opposite AC polarities, in synchronism with which the common voltages (Vcom) providing the voltages of the opposed electrodes of the liquid crystal are inverted thereby to effect the AC drive.

Now, these display operation will be explained. In FIG. 21, the liquid crystal controller 101 receives the display signal group 100 for displaying 256 gray scale levels of eight bits each of RGB with 1638400 colors, from a system unit such as the personal computer not shown, and converts the signal at the timing of the data drivers 107-1 to 107-8 and the scanning driver 109 for driving the liquid crystal. In the liquid crystal controller 101, the data drivers 7-1 to 7-8 generate 64 gray scale levels of voltages, so that eight bits each of RGB are converted into the display data of 6 bits subjected to FRC control before display of 256 gray scale levels. The FRC control is a method for applying a different gray scale voltage for each frame thereby to display an intermediate gray scale level. Thus, the liquid crystal controller 101 displays 256 gray scale levels including 3 gray scale levels for each of the voltage gray scale levels 0 to 63 based on the voltage and 6 gray scale levels as FRC gray scale levels by FRC control between the voltage gray scale levels 62 and 63.

In the liquid crystal controller 101, with six bits each of RGB as two pixels in parallel, the display data are transferred serially using the data bus of 36 bits. In the data drivers 107-1 to 107-8, the display data are retrieved sequentially, two pixels for each of RGB at a time, with the data retrieval clock 102.

The time of this data retrieval will be explained with reference to FIGS. 21 and 24. The display data 105 are transferred in synchronism with the data retrieval clock 102. At the timing for validating the display data, the valid data start signal 103 is output by the liquid crystal controller 101. Thus, the data driver 107-1 in the first stage starts display data retrieval. The data driver 107-1 retrieves two pixels each of RGB as display data, and completes retrieval of the display data corresponding to 480 outputs with 80 clocks. Upon complete retrieval of display data in the same stage, the data driver 1071 outputs the valid data start signal 134-1 to the data driver 107-2 in the next stage, so that the data driver 107-2 starts retrieval of the display data. The remaining data drivers 107-3 to 107-8 repeat a similar operation thereby to apply a line of display data to the data latch circuit A122.

Then, all the display data on one line of the data latch circuit A122 are latched at the same time in the data lath circuit B124 with the data horizontal sync signal 104. The gray scale voltage corresponding to the display data 125 of each output is selected by the gray scale voltage select circuit 126 and buffered in the output buffer circuit 128, so that the gray scale drive voltages 129-1 to 129-8 are output on one line at the same time.

On the other hand, the scanning driver 109 selects the gate line for the first line in synchronism with the scanning horizontal sync signal CL3 at the timing of the frame sync signal FLM generated in the liquid crystal controller 101, and also in synchronism with the scanning horizontal sync signal CL3, selects the gate lines for the second and third lines sequentially. The 1024 lines are sequentially selected with 1024 clocks of the scanning horizontal sync signal CL3, and upon validation of the next frame sync signal FLM, the gate line for the first line is selected. In this way, the operation of selecting 1024 lines is repeated in frame period thereby to perform sequential line select operation. Thus the gray scale drive voltages 129-1 to 129-8 are output on the data line of the liquid crystal panel 110 by the data drivers 107-1 to 107-8 thereby to realize the display corresponding to the display data.

Now, the gray scale control operation will be explained. The positive reference voltage 131 and the negative reference voltage 132 generated in the power circuit 108 are switched with the AC signal 119 by the switching circuit 133, and the gray scale voltage 116 is applied as a reference voltage 117 of nine levels V0 to V8 to the gray scale voltage generating circuit 115.

At the same time, in the switching circuit 133, as shown in FIG. 23, the common voltage is switched by the AC signal 119 in accordance with whether a positive gray scale voltage or a negative scale voltage is applied, thereby driving the common electrode of the liquid crystal panel 110. The gray scale voltage generating circuit 115 generates the gray scale voltage 116 of 64 levels from the reference voltage 117 of 9 levels V0 to V8. In the case where the reference voltage 117 is positive, the positive gray scale voltage is generated, and vice versa.

FIGS. 25, 26, 27 and 28 are diagrams showing an internal configuration of the gray scale voltage generating circuit 115. Numeral 501 designates a reference voltage generating circuit, and numeral 502 select reference voltages of 64 levels VS0 to VS63. Numeral 503 designates a circuit for selecting reference voltages from select reference voltages 502. Numeral 504 designates gray scale generating reference voltages, and numeral 505 a gray scale voltage generating circuit for generating the gray scale voltages 116 of 64 gray scale levels (VG0 to VG63) for driving the liquid crystal panel from the gray scale generating reference voltages 504.

Now, the operation of each circuit for generating the gray scale voltage will be explained. The reference voltage generating circuit 501, as shown in FIG. 26, generates select reference voltages 502 of 8 levels VS0 to VS7 by dividing the section between V0 and V1 by eight. The section between V1 and V2 is also divided by eight similarly to generate select reference voltages of 8 levels VS8 to VS15. By dividing each section between the reference voltages V2 and V8 in similar fashion, the select reference voltages 502 of 64 levels VS0 to VS63 are generated. The select circuit 503 performs the operation of selecting, from the select reference voltages 502, the reference voltages for generating the gray scale voltages in the gray scale voltage generating circuit 505.

In FIG. 26, the gray scale voltage generating circuit 505 generates the gray scale voltages by dividing each section between the reference voltages V1B and V7B. The eight levels VG0 to VG7 of the gray scale voltages, for example, are generated by dividing by eight the section between the reference voltage V0 and the gray scale generating reference voltage V1B selected in the select circuit 503. The eight levels VG8 and VG15 of the gray scale voltages are generated by dividing by eight the section between the gray scale generating reference voltages V1B and V2B selected in the select circuit 503. In a similar manner, the gray scale voltages VG16 to VG55 are generated by dividing the section between V2B and V7B. The eight levels VG56 to VG63 of the gray scale voltages are generated by dividing by eight the section between the gray scale generating reference voltage V1B selected in the select circuit 503 and the reference voltage V8. As a result, the gray scale voltages can be controlled by controlling the selection of the gray scale generating reference voltages 504 in the select circuit 503 using the gray scale control signal 114. In FIG. 26, the buffer amplifier 506 buffers the select voltages and connects the gray scale generating reference voltages V1B to V7B to the gray scale voltage generating circuit 505. For example, the gray scale generating reference voltage V1B is generated by selecting one of the 32 levels of the select reference voltages VS0, VS1 to VS31. Also, the gray scale generating reference voltage V2B is generated by selecting one of the 32 levels of the select reference voltages VS0, VS1 to VS31. In similar fashion, the gray scale generating reference voltage V3B is generated by selecting one of the 32 levels of the select reference voltages VS8, VS9 to VS39; the gray scale generating reference voltage V4B is generated by selecting one of the 32 levels of the select reference voltages VS16, VS17 to VS47; the gray scale generating reference voltage V5B is generated by selecting one of the 32 levels of the select reference voltages VS25, VS26 to VS56; the gray scale generating reference voltage V6B is generated by selecting one of the 32 levels of the select reference voltages VS32, VS33 to VS63; and the gray scale generating reference voltage V7B is generated by selecting one of the 32 levels of the select reference voltages VS32, VS33 to VS63.

In FIG. 26, numerals 507, 508 designate select circuits for selecting the reference voltages V0, V8, respectively. The internal configuration of these circuits are shown in FIGS. 27, 28, respectively. In FIG. 27, the gray scale voltages VG2, VG4, VG6, VG10, VG12, VG14 of the gray scale voltage generating circuit 505 are connected to B1 to B6, respectively. The voltage dividing point at which the select switch is validated by the select signal 114 is connected with the reference voltage V0. Similarly in FIG. 28, the gray scale voltages VG50, VG52, VG54, VG58, VG60, VG62 of the gray scale voltage generating circuit 505 are connected to W6 to W1, respectively, and the voltage dividing point at which the select switch is validated by the select signal 114 is connected with the reference voltage V8. These select circuits 507, 508 fix the low gray scale area and the high gray scale area of the gray scale voltage generating circuit 505 at the voltage levels of the reference voltage V0 and the reference voltage V8, respectively.

Now, the configuration and the operation of the gray scale control register will be explained. According to the second embodiment, the gray scale control register has a configuration similar to that of the first embodiment. An explanation will be given, therefore, with reference to FIGS. 9 to 12 again. The gray scale control register 113 writes the set data from the liquid crystal controller 101 using the data bus of 36 bits. FIG. 9 shows the bit structure of the gray scale control register, and FIG. 10 the bit structure of the data bus. As shown in FIG. 9, the gray scale control register is configured of ten 6-bit registers including Nos. 1 to 9 for setting B1 to B6, W1 to W6, and a control register No. 10 for setting V1B to V7B.

As shown in FIG. 10, the 36 bits including RO[5:0], RE[5:0], GO[5:0], GE[5:0], BO[5:0], BE[5:0] are assigned to ports 0 to 5, respectively, among the 48 bits including RO[7:0], RE[7:0], GO[7:0], GE[7:0], BO[7:0], BE[7:0] of two pixels of 8 bits each of RGB on the data bus. According to the second embodiment, however, the registers Nos. 3 to 9 for setting V1B to V7B are select circuits of 32 levels, and therefore the five bits D4 to D0 are validated while the bit D5 is invalidated. The control register is assigned to port 5, and the other registers are assigned to ports 0 to 4 shown in FIG. 9. The bits P0 to P4 of the control register are used to determine whether the write operation of each gray scale control register is valid or invalid, and the gray scale control registers assigned to the same port are selected by the RS bit. This register configuration permits all the gray scale control registers to be set in two write operations.

Figure 12:
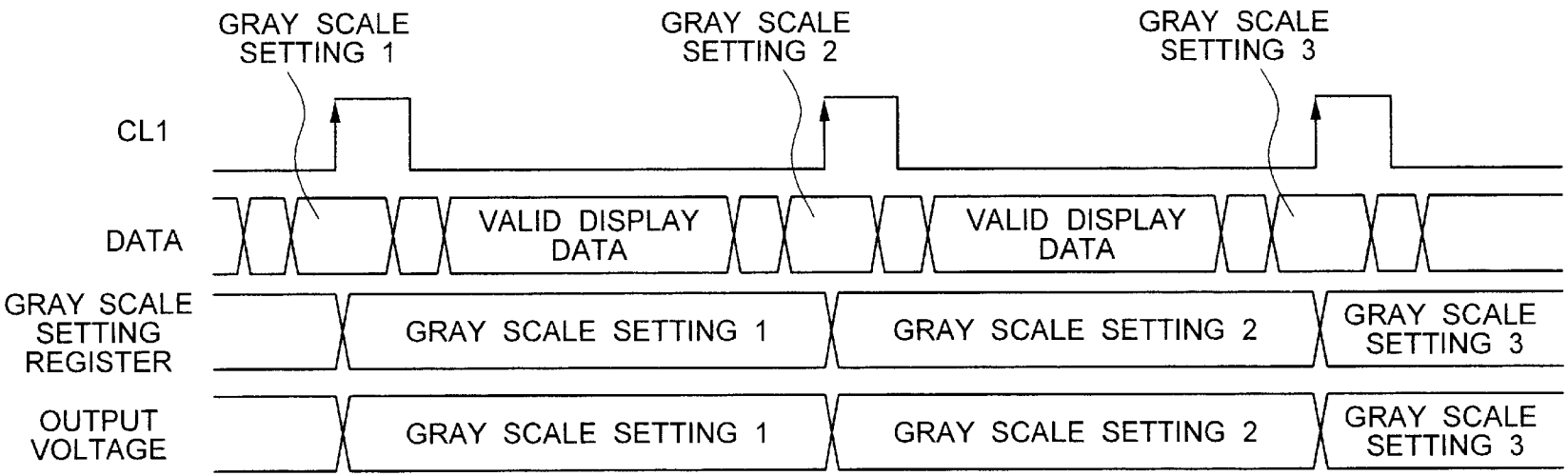
FIG. 12 is a timing chart for setting the gray scale control register.

The write operation and the circuit configuration of the gray scale control register according to the second embodiment are similar to those of the first embodiment as shown in FIGS. 1 and 12.

As described above, the gray scale control operation free of gray scale irregularities in the data conversion control can be realized by writing the set data in the gray scale control register and thus setting the gray scale generating reference voltage for the gray scale voltage generating circuit.

Now, the gray scale control operation implemented by the invention will be explained with reference to FIGS. 13 to 18. In the second embodiment, the gray scale control operation can be performed in a similar manner to the first embodiment.

The histogram extension control operation in FIGS. 13, 14, 15 can be performed according to this embodiment, like in the first embodiment, in such a manner that the brightness distribution of pixels on the display screen is checked, and in the case where the pixels in low gray scale or high gray scale area are small in number, the contrast of the area with a small number of pixels is reduced, while the contrast of the area with a great number of pixels is increased thereby to improve the contrast of the whole screen.

Also, the histogram extension control operation according to this embodiment can be easily realized in such a manner that the brightness distribution is checked by the liquid crystal controller 101, and based on the result of the check, B1 to B6 and W1 to W6 of the gray scale control registers Nos. 1 and 2 are set. In this way, the voltage in the low gray scale area or in the high gray scale area can be fixed to V0 (VG0) or V8 (VG63) for each eight gray scale levels.

The gray scale control operation can be performed similarly to the first embodiment also for the gamma curve control shown in FIGS. 16, 17. According to this embodiment, the liquid crystal controller 101 determines whether the video signal input is for the animation display such as TV broadcast or DVD or the display of a text or a document for OA applications. Based on the result of this determination, the gray scale control registers Nos. 3 to 9 are set thereby to set the gray scale generating reference voltages V1B to V7B. In this way, the gray scale control with the gamma curve is performed, and the gamma curve can thus be easily set arbitrarily.

The gray scale control operation can be performed similarly to the first embodiment also for the equalize extension control shown in FIG. 18. According to this embodiment, the brightness distribution is checked by the liquid crystal controller 101, and based on the result of this check, the gray scale control registers Nos. 3 to 9 are set, and by thus setting the gray scale generating reference voltages V1B to V7B, the gray scale control operation with the equalize extension control is performed. In this way, the setting of the contrast control can be easily realized for each gray scale area.

Now, a configuration of the liquid crystal controller for performing the gray scale control operation will be explained with reference to FIG. 29. FIG. 29 shows a configuration for performing the gray scale control operation based on the result of analyzing the video data using the liquid crystal controller and the gray scale control signal indicating the gray scale control through the user setting circuit of the liquid crystal display. In FIG. 29, numeral 601 designates a liquid crystal drive control circuit for generating a data sync clock 102, a valid data start signal 103, a data horizontal sync signal 104 and an AC signal 119 for driving the liquid crystal panel from the display signal group 100. Also, in the liquid crystal drive control circuit 601, the FRC control operation is performed for the 8-bit data of RGB which is thus converted to the display data of 6-bit RGB. Numeral 602 designates an image analysis circuit in which the video information including the brightness distribution (histogram), the average brightness and the gamma curve of the display data of the display signal group 100 are analyzed in the video analysis circuit and the resulting analysis data is output to the gray scale control determination circuit 603. Further, numeral 600 designates a user setting circuit such as a switch arranged on the liquid crystal display and adapted to be set by the user. The gray scale control determination circuit 603 determines the gray scale control based on the video analysis data from the video analysis circuit 602 and the gray scale control signal 609 indicating the setting of the gray scale produced from the user setting circuit 600. The set data generating circuit 604 generates the set data 606 set in the gray scale control registers of the data drivers 107-1 to 107-8. The set data 606 and the display data 605 can share the data bus by being switched in the select circuit 607 in accordance with the select signal 608 at the timing shown in FIG. 12. In this way, the gray scale control operation can be performed for each animation frame or scene or in accordance with the preferences of the user by analyzing the image with the liquid crystal controller and changing the setting of the gray scale control registers of the data drivers.

According to this embodiment, nine reference voltages are set in accordance with the 64 gray scale display levels (256 gray scale display levels by FRC control). The invention, however, is not limited to this figure, and the gray scale control can be implemented also in the case where five each of positive and negative reference voltages are set. Also, the gray scale generating reference voltages V1B to V7B can be for each 16 gray scale levels instead of each 32 gray scale levels to realize the gray scale control according to the invention.

Now, a third embodiment of the invention will be explained with reference to FIGS. 9 to 18 and FIGS. 30 to 36. The third embodiment is different from the first and second embodiments in that the common inversion drive is employed, and the gray scale display is realized by use of data drivers of 64 gray scale levels having a display memory built therein.

Figure 30:
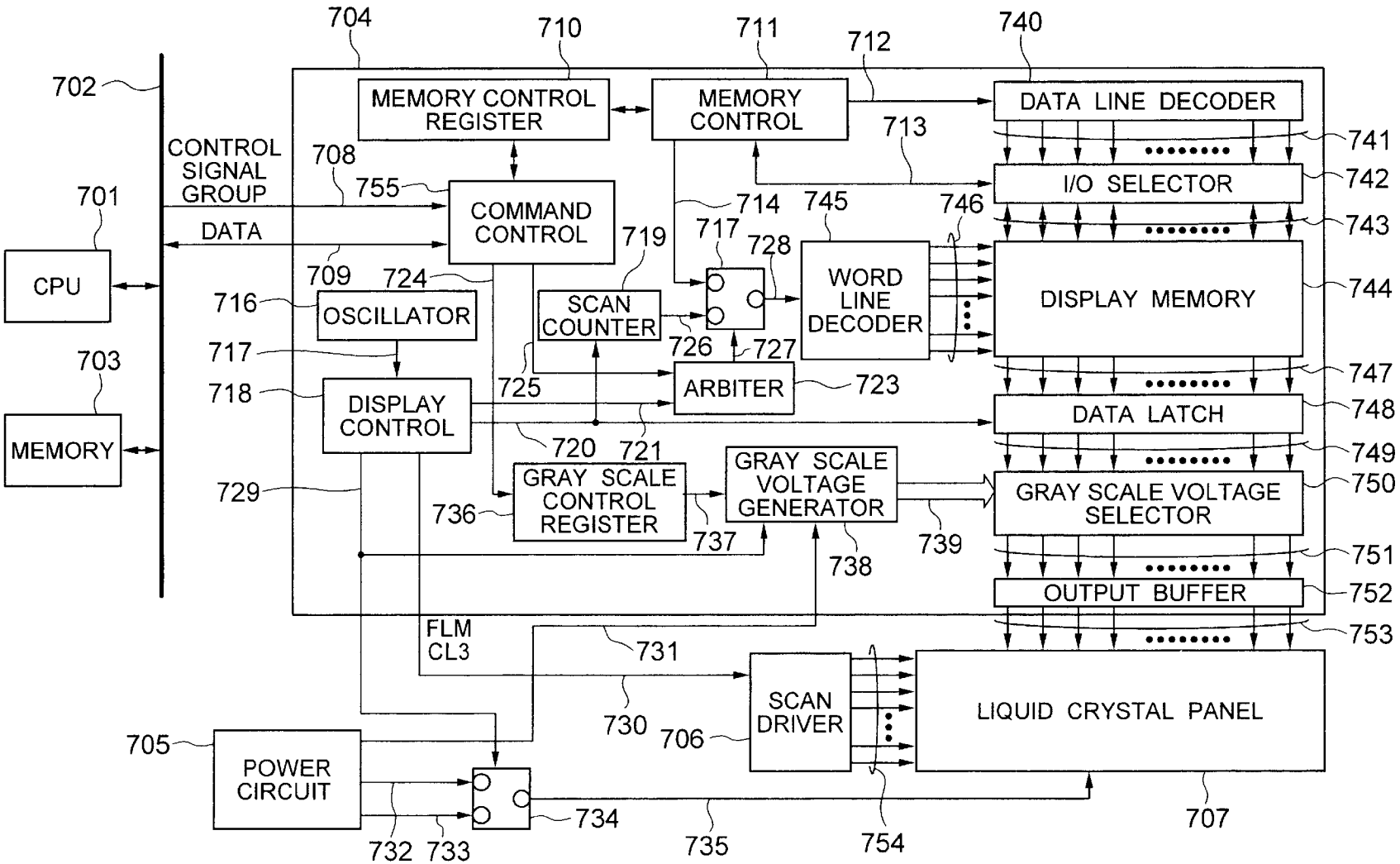
FIG. 30 is a block diagram showing a liquid crystal display apparatus according to an embodiment of the invention.

FIG. 30 is a diagram showing a configuration of a liquid crystal panel drive circuit according to this invention, in which a liquid crystal display on the liquid crystal panel of 160×RGB×240 is realized with 64 gray scale levels for each of RGB and 262144 display colors. Numeral 701 designates a CPU of a system unit, numeral 702 a system bus containing a control signal and data, numeral 703 a memory, and numeral 704 a data driver for producing 480 (=160×RGB) outputs and having built therein a display memory for 240 lines. Numeral 705 designates a power circuit for generating a gray scale reference voltage 731 for driving the liquid crystal and the common voltages 732, 733 of the common electrode of the liquid crystal panel. Numeral 706 designates a scanning driver for scanning the liquid crystal panel 707. Numeral 708 designates a control signal group applied from the system bus 702 to the data driver 704, data bus 709 designates a control signal group applied from the system bus 702 to the data driver 704. Numeral 755 a command control circuit for controlling the display memory 744 and the gray scale control register 736 in response to a command from the CPU 701, numeral 710 a memory control register for holding the address and the data of the display memory, and numeral 711 a memory control circuit for controlling the data address 712, the word address 714 and the memory bus 713 corresponding to the memory control register 710.

Numeral 716 designates an oscillation circuit for generating a reference clock 717 for display timing, numeral 718 a display control circuit for controlling the display timing, numeral 719 a scanning counter operated in accordance with the data horizontal sync signal 720, and numeral 723 an arbiter circuit for arbitrating as to whether the memory access or the display access is selected for the display memory 744, based on the memory access signal 725 generated in the command control circuit 755 and the display access signal 721 generated in the display control circuit 718. Numeral 715 designates a word address select circuit for selecting the word address 714 and the display address 726 by the display switching signal 727, and numeral 728 a selected word address. Numeral 729 designates an AC signal indicating the AC timing, and numeral 730 a scanning control signal applied to the scanning driver 706. Numeral 736 designates a gray scale control register for performing the gray scale control operation, numeral 738 a gray scale voltage generating circuit for generating a gray scale voltage based on the gray scale control signal 737, and numeral 739 a gray scale voltage signal group. Numeral 740 designates a data line decoder for decoding the data address of the display memory 744, numeral 741 a data line select signal for selecting the data line, numeral 742 an I/O selector for performing the read/write control operation of the display memory 744, numeral 745 a word line decoder for decoding the word address, numeral 746 a word line select signal, numeral 747 display data lines read from the display memory 744, numeral 748 a data latch circuit for latching a line of display data at the same time, numeral 749 latch display data, numeral 750 a gray scale voltage select circuit for selecting the gray scale voltage corresponding to the latch display data 749 from the gray scale voltage signal group 739, numeral 752 an output buffer circuit for outputting by buffering in the buffer circuit the select gray scale voltage 751 selected by the gray scale voltage select circuit 750, and numeral 753 gray scale drive voltages for driving the liquid crystal panel 707 of 160×RGB×240.

Figure 31:
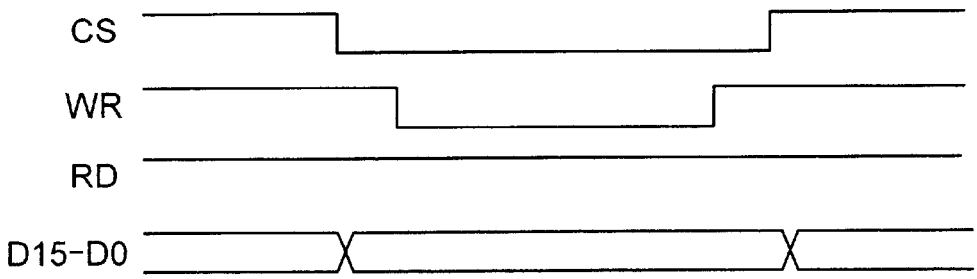
FIG. 31 is a diagram showing the write access timing of the data driver.
Figure 32:
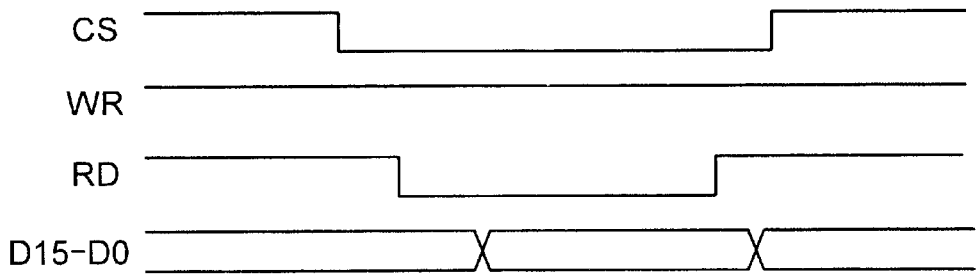
FIG. 32 is a diagram showing the read access timing of the data driver.
Figure 33:
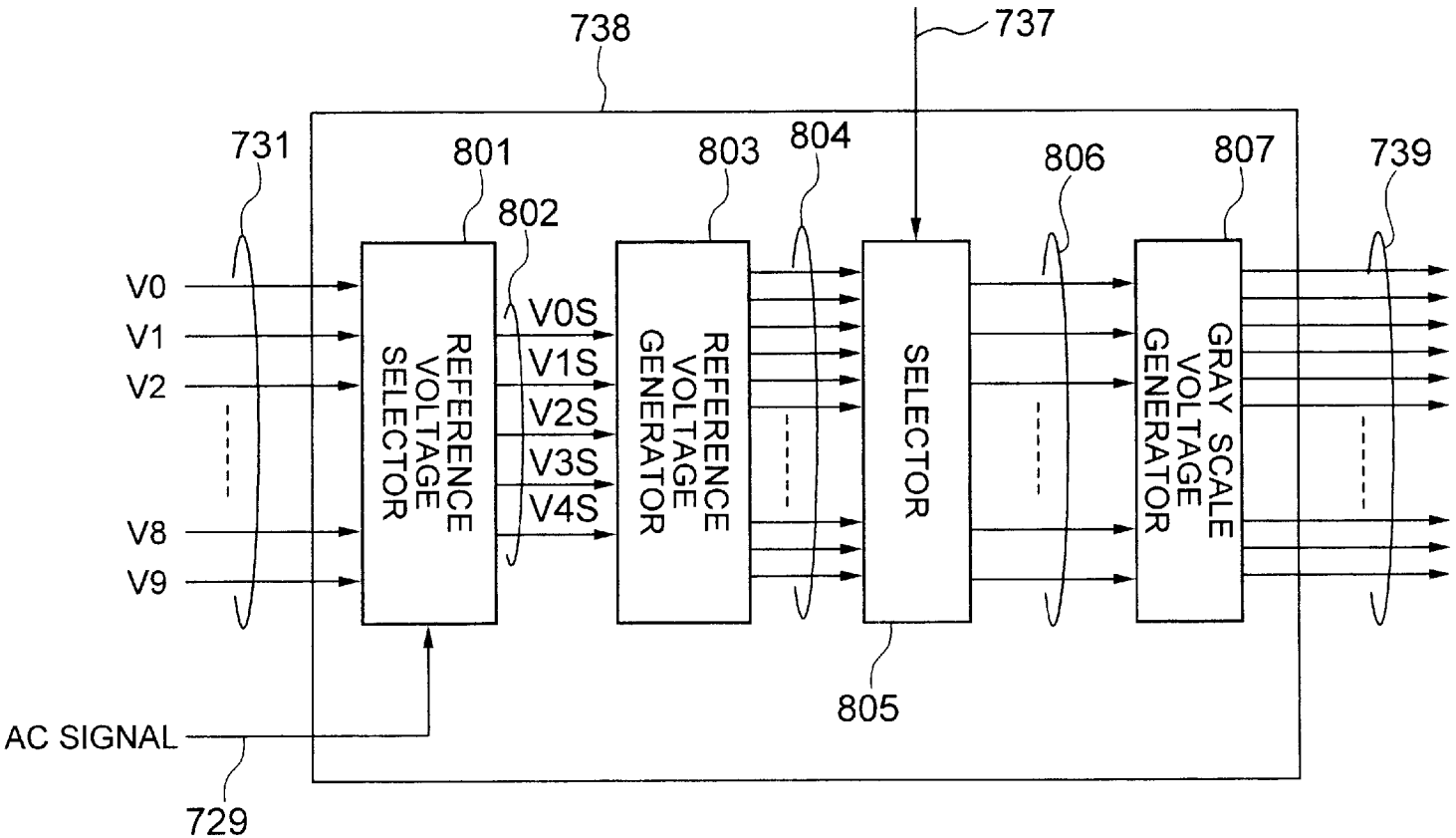
FIG. 33 is a diagram showing a configuration of a gray scale voltage generating circuit.
Figure 34:
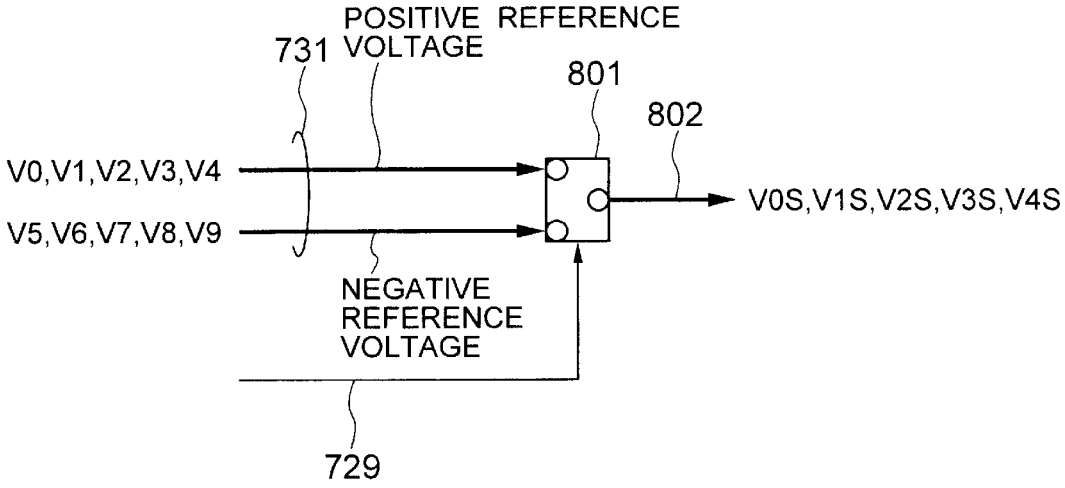
FIG. 34 is a diagram showing a configuration of a gray scale voltage generating circuit.
Figure 35:
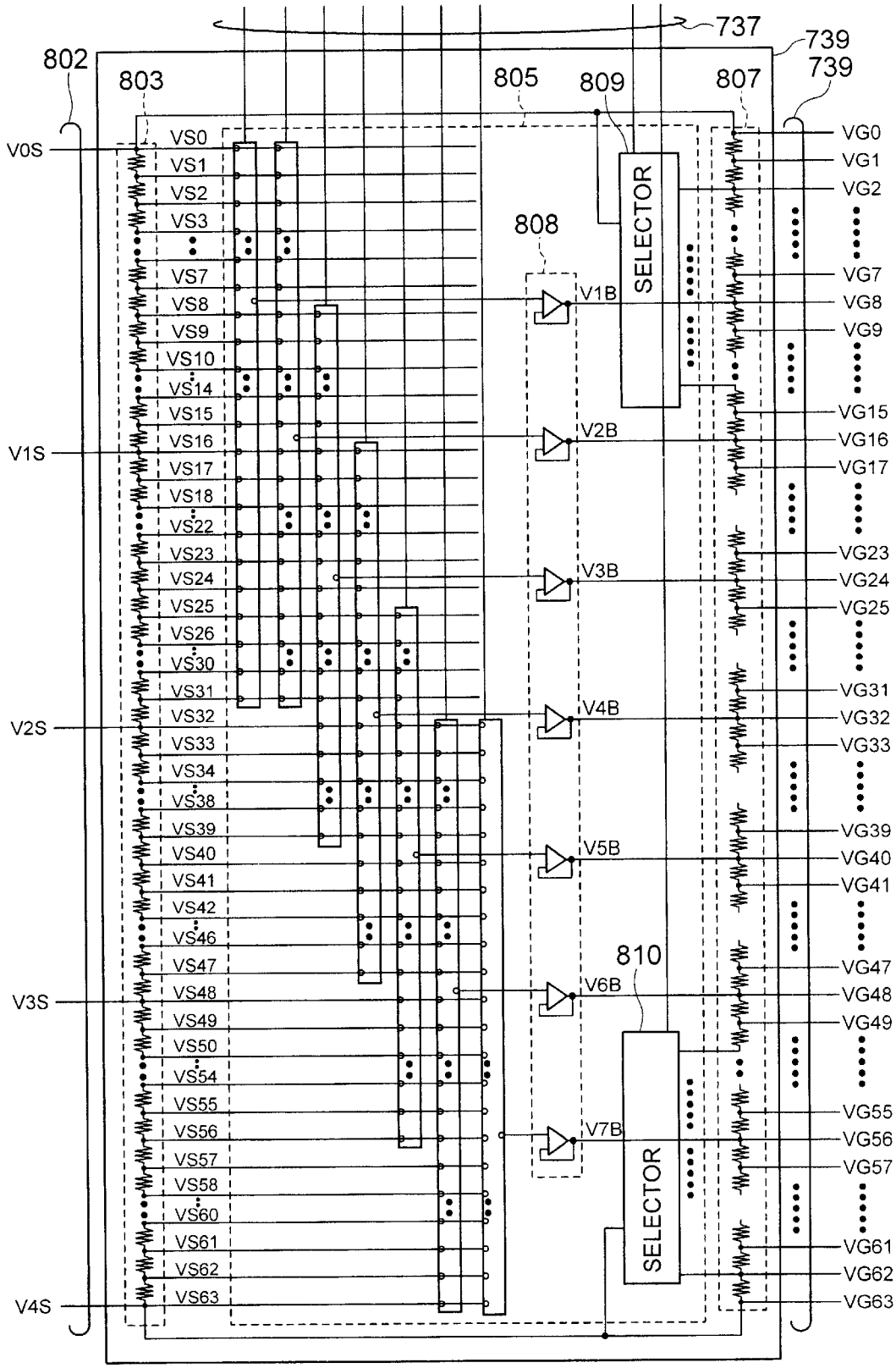
FIG. 35 is a diagram showing a configuration of a gray scale voltage generating circuit.

FIGS. 31, 32 are diagrams showing the timing of the write access and the read access of the data drivers of the CPU. FIG. 33 shows a configuration of the gray scale voltage generating circuit. FIGS. 34, 35 show a configuration of the select circuit of the gray scale voltage generating circuit, and FIG. 36 is a diagram showing the contents of the gray scale control register.

Similarly to the second embodiment, this embodiment, as shown in FIG. 22, employs the common inversion drive in which the pixels on the same line have the same AC polarity while the pixels on adjacent lines have opposite AC polarities. As shown in FIG. 23, therefore, the AC polarities of adjacent lines are opposite to each other, and in synchronism with this, the common voltages (Vcom) providing the voltages of the opposed electrodes of the liquid crystal is inverted thereby to effect the AC drive. Then, this display operation will be explained. In FIG. 30, the CPU 701 writes the display data in the display memory 744 built in the data driver 704. The CPU 701 transfers the control signal group 708 and the data 709 through the system bus 702, and as shown in FIGS. 31, 32, transfers a command to the data driver 704 by the chip select signal CS, the write signal WR, the read signal RD and 16-bit data D15 to D0 to perform the write/read control operation of the display memory and the gray scale control operation of the gray scale control register. In the case where the display data is written in the display memory 744, for example, the CPU 701 transfers a write command of the display memory address to the data driver 704 thereby to transfer the address, followed by transferring a write command for the display data thereby to transfer the display data. The data driver 704 holds the address of the display memory in the memory control register 710 in accordance with the write command of the display memory address. In accordance with the write command of the display data, the memory control circuit 711 sets the address for writing in the data line decoder 740 and the word line decoder 745, and writes the display data in the display memory 744. This operation is performed for each address of the display memory, and thus the data of one screen can be written in the display memory 744. The display data in the display memory 744 are such that the scanning counter 719 generates the display word address 726 of the display line in accordance with the data horizontal sync signal 720 generated in the display control circuit 718 from the display reference clock 717 generated in the oscillation circuit 716, and the word address select circuit 715 selects the display word address 726 during the display period, so that the word line to be displayed is selected by the word line decoder 745. The display data 747 corresponding to 480 outputs of the display memory 744 are latched at the same time in the data latch circuit 748 by the data horizontal sync signal 720. The gray scale voltage signal group 739 corresponding to the display data 749 for each output is selected by the gray scale voltage select circuit 750, buffered in the output buffer circuit 752, and a line of the gray scale drive voltages 753 are output at the same time.

On the other hand, the scanning driver 706 selects the gate line for the first line in synchronism with the scanning horizontal sync signal CL3 at the timing of the frame sync signal FLM generated in the data driver 704, and then selects the gate lines for the second and third lines sequentially in synchronism with the scanning horizontal sync signal CL3. Assume that 1024 lines are sequentially selected with 1024 clocks of the scanning horizontal sync signal CL3 and the next frame sync signal FLM is validated. The gate line for the first line is selected. In this way, the operation of selecting 240 lines is repeated in the frame period thereby to perform the sequential line select operation, and the gray scale drive voltage 753 is output on the data line of the liquid crystal panel 707 by the data driver 704 thereby to realize the display corresponding to the display data.

Now, the gray scale control operation will be explained. The gray scale voltage signal group 739 supplies the gray scale voltage generating circuit 738 with the reference voltages 731 of 10 levels including the positive reference voltages V0 to V4 and the negative reference voltages V5 to V9 generated in the power circuit 705. FIGS. 33, 34, 35 show an internal configuration of the gray scale voltage generating circuit 738, in which numeral 801 designates a reference voltage select circuit, numeral 802 reference voltages, numeral 803 a reference voltage generating circuit, and numeral 804 select reference voltages of 64 levels VS0 to VS63. Numeral 805 designates a circuit for selecting a reference voltage from the select reference voltages 804, numeral 806 gray scale generating reference voltages, and numeral 807 a gray scale voltage generating circuit for generating the gray scale voltages 739 of 64 gray scale levels (VG0 to VG63) from the gray scale generating reference voltages 806 for driving the liquid crystal panel.

Now, the operation of generating the gray scale voltages in each circuit will be explained. The reference voltage select circuit 801 selects the positive voltages V0 to V4 and the negative voltages V5 to V9 in accordance with the AC signal 729. Thus, the gray scale voltage generating circuit 738 generates the gray scale voltages 739 of 64 levels from 10 levels V0 to V9 of the reference voltages 731. In the case where the AC signal 729 is positive, the positive gray scale voltages are generated, and vice versa. In the process, as shown in FIG. 23, the switching circuit 734 switches the positive common voltage 732 and the negative common voltage 732 by the AC signal 729 in accordance with whether the positive gray scale voltage or negative gray scale voltage is applied, thereby driving the common electrode of the liquid crystal panel 707.

The reference voltage generating circuit 803, as shown in FIG. 35, generates select reference voltages 804 of 16 levels VS0 to VS15 by dividing the section between the voltages V0S and V1S by 16, and similarly generates select reference voltages of 16 levels VS16 to VS31 by dividing the section between the voltages V1S and V2S by 16. Similarly, by generating the select reference voltages by dividing each section between the voltages V2S and V4S, the select reference voltages 804 of 64 levels VS0 to VS63 are generated. The select circuit 805 performs the operation of selecting the reference voltages from the select reference voltages 804 for generating the gray scale voltages in the gray scale voltage generating circuit 807. In FIG. 35, the gray scale voltage generating circuit 807 generates gray scale voltages by dividing each section between the reference voltages V1B and V7B. The eight levels VG0 to VG7 of the gray scale voltages are generated by dividing by 8 the section between the reference voltage V0S and the gray scale generating reference voltage V1B selected by the select circuit 805. The eight levels VG8 to VG15 of the gray scale voltages are generated by dividing by 8 the section between the gray scale generating reference voltages V1B and V2B selected in the select circuit 805. In similar fashion, the gray scale voltages VG16 to VG55 are generated by dividing each section between the voltages V2B and V7B. The eight levels VG56 to VG63 of the gray scale voltages are generated by dividing by eight the reference voltage V4S and the gray scale generating reference voltage V7B selected by the select circuit 805. The select circuit 805, therefore, can control the gray scale voltages by controlling the voltage selection of the gray scale generating reference voltages 806 in accordance with the gray scale control signal 737. In FIG. 35, the buffer amplifier 808 buffers the select voltage and connects the gray scale generating reference voltages V1B to V7B with the gray scale voltage generating circuit 807. The gray scale generating reference voltage V1B, for example, is generated by selecting one of the 32 levels of the select reference voltages VS0, VS1 to VS31. The gray scale generating reference voltage V2B, on the other hand, is generated by selecting one of the 32 levels of the select reference voltages VS0, VS1 to VS31. In similar fashion, the gray scale generating reference voltage V3B is generated by selecting one level of the 32 levels of the select reference voltages VS8, VS9 to VS39; the gray scale generating reference voltage V4B is generated by selecting one of the 32 levels of the select reference voltages VS16, VS17 to VS47; the gray scale generating reference voltage V5B is generated by selecting one of the 32 levels of the select reference voltages VS25, VS26 to VS56; the gray scale generating reference voltage V6B is generated by selecting one of the 32 levels of the select reference voltages VS32, VS33 to VS63; and the gray scale generating reference voltage V7B is generated by selecting one of the 32 levels of the select reference voltages VS32, VS33 to VS63.

In FIG. 35, numerals 809, 810 designate select circuits for selecting the reference voltages V0S, V4S, respectively. These circuits have a similar internal configuration to the corresponding circuits for selecting the voltages V0, V8 in the second embodiment shown in FIGS. 27, 28. Like in FIG. 27, also in the gray scale voltage generating circuit 809, the gray scale voltages VG2, VG4, VG6, VG10, VG12, VG14 of the gray scale voltage generating circuit 807 are connected to B1 to B6, and the reference voltage V0S is connected to a voltage dividing point where the select switch is validated by the select signal 737. Also like in FIG. 28, in the gray scale voltage generating circuit 810, the gray scale voltages VG50, VG52, VG54, VG58, VG60, VG62 of the gray scale voltage generating circuit 807 are connected to W6 to W1, and the reference voltage V4S is connected to a voltage dividing point where the select switch is validated by the select signal 737. By these select circuits 809, 810, the low gray scale area of the gray scale voltage generating circuit 807 is fixed to the voltage level of the reference voltage V0S, and the high gray scale area of the gray scale voltage generating circuit 807 is fixed to the voltage level of the reference voltage V4S.

Now, the configuration and operation of the gray scale control register 736 will be explained. According to the third embodiment, as shown in FIG. 36, nine gray scale control registers Nos. 1 to 9 are provided for setting B1 to B6, W1 to W6 and V1B to V7B. The write operation into the gray scale control register 736, like the write operation into the display memory 744, is performed at the timing shown in FIG. 31. The CPU 701 writes the gray scale control data in the gray scale control register 736 built in the data driver 704. The CPU 701 transfers the control signal group 708 and the data 709 through the system bus 702, and as shown in FIG. 31, transfers a command to the data driver 704 by the chip select signal CS, the write signal WR, the read signal RD and the data D15 to D0 of 16 bits thereby to control the gray scale control registers. In the case where the gray scale control data are written in the gray scale control registers 736, for example, the CPU 701 transfers the address (No.) by transferring the write command of the gray scale control registers to the data driver 704, followed by transferring the gray scale control data by transferring the write command of the gray scale control data. In the data driver 704, a gray scale control register is designated in response to the write command of the address of the gray scale control register, and the gray scale control data is written in the gray scale control control register 736 designated in response to the write command of the gray scale control data.

As described above, the gray scale control free of gray scale irregularities in the data conversion control can be realized by writing the set data in the gray scale control registers and setting the gray scale generating reference voltages of the gray scale voltage generating circuit.

Now, the gray scale control operation realized by this invention will be explained with reference to FIGS. 13 to 18. According to the third embodiment, the gray scale control operation can be performed similarly to the first embodiment.

In the histogram length control operation shown in FIGS. 13, 14, 15 according to this embodiment, like in the first embodiment, the brightness distribution of the pixels on the display screen is checked, so that in the case where the pixels in the low gray scale area or the high gray scale area is small in number, the contrast of the area having a small number of pixels is reduced, and vice versa, thereby improving the contrast of the whole screen. This histogram is held in the gray scale control register as data indicating the correspondence relationships between the liquid crystal display data and the liquid crystal gray scale voltage. The gray scale generating reference voltage is determined in accordance with the histogram generated for each frame.

According to this embodiment, the histogram length control operation can be also easily realized in such a manner that the brightness distribution is checked by the CPU 701, and based on the result of the check, B1 to B6 and W1 to W6 of the gray scale control registers Nos. 1 and 2 are set. In this way, the voltage in the low or high gray scale area can be fixed to V0S (VG0), V4S (VG63) for each eight gray scale levels.

The gray scale can be controlled also by the gamma curve control operation shown in FIGS. 16, 17 as in the first embodiment. According to this embodiment, the CPU 701 determines whether the input video signal is for the animation display of TV broadcast or DVD, or the display of a text or a document for OA applications, and based on the result of this determination, the gray scale control registers Nos. 3 to 9 are set. In addition, the gray scale generating reference voltages V1B to V7B are set and thus the gray scale control of the gamma curve can be effected thereby to easily realize an arbitrary setting of the gamma curve.

With regard to the equalize length control shown in FIG. 18, on the other hand, it is also possible to carry out the gray scale control operation like in the first embodiment. According to this embodiment, the brightness distribution is checked by the CPU 701, and based on the result of this check, the gray scale control registers Nos. 3 to 9 are set, and by setting the gray scale generating reference voltages V1B to V7B, the gray scale control operation by the equalize length control can be carried out, so that the contrast control operation can be easily set for each gray scale area.

As described above, according to this embodiment, the gray scale control operation is performed by the data driver having a display memory built therein, and the power consumption of the liquid crystal display system can be reduced by transferring the display data from the CPU to the display memory only when the screen undergoes a change.

Although the present embodiment is explained on the assumption that the scanning driver and the data driver are configured in different chips, a similar gray scale control can be realized also by configuring the data driver and the scanning driver on the same chip.

Also, the invention is not limited to the five reference voltages for each of positive and negative polarities corresponding to the display of 64 gray scale levels, but a similar gray scale control can be implemented by setting nine reference voltages for each of the positive and negative polarities. Further, the gray scale generating reference voltages V1B to V7B can be set for each 16 gray scale levels instead of each 32 gray scale levels with equal effect.

According to this invention, the gray scale control free of gray scale irregularities in the data conversion control can be realized by setting the gray scale generating reference voltages of the gray scale voltage generating circuit and thus controlling the gray scale voltages.

Also, the optimum gray scale control operation can be performed for each animation frame or video scene by analyzing the image with a liquid crystal controller and changing the setting of the gray scale control registers of the data driver.

Further, an arbitrary setting of a gamma curve can be easily realized by setting the gray scale control registers in accordance with whether the input video signal is for the animation display such as TV broadcast or text display for OA applications.

Furthermore, the gray scale control registers of the data driver are set using the data bus for transferring the display data, and therefore the number of terminals of the liquid crystal controller and the data driver is not increased.

What is claimed is:

1. A display driving device for outputting gray scale voltages to a display panel, comprising:

a circuit for generating a plurality of levels of gray scale voltages from a plurality of levels of reference voltages generated by a power circuit: and a circuit for selecting gray scale voltages to be outputted to said display panel, from said plurality of levels of gray scale voltages in accordance with display data, wherein said circuit for generating the gray scale voltages adjusts each of the levels of the gray scale voltages according to a distribution of brightness represented by said display data;

wherein said circuit for generating the gray scale voltages includes a first voltage generating circuit for generating a plurality of levels of first voltages from said plurality of levels of the reference voltages, a selector circuit for selecting a plurality of levels of second voltages from said plurality of levels of the first voltages, and a second voltage generating circuit for generating said plurality of gray scale voltages from said plurality of levels of the second voltages, and said circuit for generating the levels of the gray scale voltages determines said plurality of levels of the second voltages to be selected by said selector circuit according to said distribution of brightness, thereby to adjust each of the levels of the gray-scale voltages.

2. A display driving device according to claim 1, wherein said plurality of levels of the first voltages are voltages of 256 levels.

3. A display driving device according to claim 1, wherein said plurality of levels of the gray scale voltages are voltages of 256 levels.

4. A display driving device according to claim 1, wherein said first voltage generating circuit generates said plurality of levels of the first voltages by dividing a section between two first voltages having adjacent levels, by 32.

5. A display driving device according to claim 1, wherein said second voltage generating circuit generates said plurality of levels of the gray scale voltages by dividing a section between two second voltages having adjacent levels, by 32.

6. A display driving device according to claim 1, wherein said selector circuit selects said plurality of levels of the second voltages from said plurality of levels of the first voltages in such a manner that a contrast of gray scale having a relatively small number of pixels in said distribution of brightness is relatively reduced.

7. A display driving device according to claim 1, wherein said selector circuit selects said plurality of levels of the second voltages from said plurality of levels of the first voltages in such a manner that a contrast of gray scale having a relatively great number of pixels in said distribution of brightness is relatively increased.

8. A display driving device according to claim 1, wherein said circuit for generating gray scale voltages is provided with a register for holding correspondence relationships between said display data and said gray scale voltages, said correspondence relationships being generated based on said distribution of brightness; and wherein said circuit for generating gray scale voltages adjusts each of the levels of said gray scale voltages with reference to said correspondence relationships.

9. A display driving device according to claim 1, wherein said circuit for selecting gray scale voltages selects gray scale voltages to be outputted to said display panel, from said plurality of levels of gray scale voltages for each line of said display data.

10. A display driving device according to claim 1, wherein said distribution of brightness is that of the display data for one screen or one frame.

11. A display driving device according to claim 1, wherein said distribution of brightness is that of the display data for one line.

12. A display driving device according to claim 1, wherein said distribution of brightness represents numbers of pixels for a plurality of gray scale levels.

13. A display apparatus for displaying display data, comprising:

a display panel;

a data driver circuit for generating gray scale voltages from reference voltages generated by a power circuit;

a scanning driver circuit for selecting a line to which said gray scale voltages are outputted; and a controller circuit for controlling the driving of said data driver circuit and said scanning driver circuit based on a display control signal and said display data, wherein said data driver circuit adjusts each of the levels of the gray scale voltages according to a distribution of brightness represented by said display data;

wherein said data driver circuit includes a circuit for generating a plurality of levels of gray scale voltages from a plurality of levels of reference voltages generated by said power circuit, and a circuit for selecting gray scale voltages to be outputted to said display panel, from said plurality of levels of the gray scale voltages in accordance with said display data;

wherein said circuit for generating gray scale voltages includes a first voltage generating circuit for generating first voltages from said plurality of levels of the reference voltages, a selector circuit for selecting a plurality of levels of second voltages from said plurality of levels of the first voltages, and a second voltage generating circuit for generating said plurality of levels of the gray scale voltages from said plurality of levels of the second voltages; and wherein said circuit for generating gray scale voltages adjusts each of the levels of the second voltages to be selected by said selector circuit according to said distribution of brightness.

14. A display apparatus according to claim 13, wherein said plurality of levels of the first voltages are voltages of 256 levels.

15. A display apparatus according to claim 13, wherein said plurality of levels of the gray scale voltages are voltages of 256 levels.

16. A display apparatus according to claim 13, wherein said first voltage generating circuit generates said plurality of levels of the first voltages by dividing a section between two reference voltages having adjacent levels, by 32.

17. A display apparatus according to claim 13, wherein said second voltage generating circuit generates said plurality of levels of the gray scale voltages by dividing a section between two second voltages having adjacent levels, by 32.

18. A display apparatus according to claim 13, wherein said selector circuit selects said plurality of levels of the second voltages from said plurality of levels of the first voltages in such a manner that a contrast of gray scale having a relatively small number of pixels in said distribution of brightness is relatively reduced.

19. A display apparatus according to claim 13, wherein said selector circuit selects said plurality of levels of the second voltages from said plurality of levels of the first voltages in such a manner that a contrast of gray scale having a relatively great number of pixels in said distribution of brightness is relatively increased.

20. A display apparatus according to claim 13, wherein said circuit for generating gray scale voltages is provided with a register for holding correspondence relationships between said display data and said gray scale voltages generated based on said distribution of brightness, and wherein said circuit for generating gray scale voltages adjusts each of the levels of the gray scale voltages with reference to the correspondence relationships.

21. A display apparatus according to claim 13, wherein said circuit for selecting gray scale voltages selects gray scale voltages to be outputted to said display panel, from said plurality of levels of gray scale voltages for each line of said display data.

22. A display apparatus according to claim 13, wherein said distribution of brightness is that of the display data for one screen or one frame.

23. A display apparatus according to claim 13, wherein said distribution of brightness is that of the display data for one line.

24. A display apparatus according to claim 13, wherein said distribution of brightness represents numbers of pixels for a plurality of gray scale levels.

25. A display driving device according to claim 1, wherein:

a number of levels of the first voltages is greater than that of the reference voltages;

a number of levels of the second voltages is smaller than that of the first voltages; and a number of levels of the gray scale voltages is greater than that of the second voltages.

26. A display driving device according to claim 1, wherein:

said first voltage generating circuit generates said plurality of levels of the first voltages by dividing said plurality of levels of the reference voltages; and said second voltage generating circuit generates said plurality of levels of the gray scale voltages by dividing said plurality of levels of the second voltages.

27. A display apparatus according to claim 13, wherein:

a number of levels of the first voltages is greater than that of the reference voltages;

a number of levels of the second voltages is smaller than that of the first voltages; and a number of levels of the gray scale voltages is greater than that of the second voltages.

28. A display apparatus according to claim 13, wherein:

said first voltage generating circuit generates said plurality of levels of the first voltages by dividing said plurality of levels of the reference voltages; and said second voltage generating circuit generates said plurality of levels of the gray scale voltages by dividing said plurality of levels of the second voltages.

* * * * *